US010376735B2

(12) United States Patent
Bates et al.

(10) Patent No.: US 10,376,735 B2
(45) Date of Patent: Aug. 13, 2019

(54) MULTI-FUNCTIONAL EXERCISE ROWER

(71) Applicant: Lifecore Fitness, Inc., Carlsbad, CA (US)

(72) Inventors: Roger Bates, Carlsbad, CA (US); Marko Vujicic, Huntington Beach, CA (US); Gregory Allen Wallace, Mission Viejo, CA (US); Mark William Chiles, Yorba Linda, CA (US)

(73) Assignee: Lifecore Fitness, Inc., Carlsbad, CA (US)

( * ) Notice: Subject to any disclaimer, the term of this patent is extended or adjusted under 35 U.S.C. 154(b) by 199 days.

(21) Appl. No.: 15/653,152

(22) Filed: Jul. 18, 2017

(65) Prior Publication Data

US 2018/0056118 A1 Mar. 1, 2018

Related U.S. Application Data

(60) Provisional application No. 62/363,661, filed on Jul. 18, 2016.

(51) Int. Cl.

| | |
|---|---|
| ***A63B 21/00*** | (2006.01) |
| ***A63B 22/00*** | (2006.01) |
| ***A63B 69/06*** | (2006.01) |

(52) U.S. Cl.

CPC .... *A63B 22/0076* (2013.01); *A63B 21/00192* (2013.01); *A63B 21/153* (2013.01); *A63B 21/154* (2013.01); *A63B 21/4035* (2015.10); *A63B 22/0087* (2013.01); *A63B 69/06* (2013.01); *A63B 2022/0079* (2013.01); *A63B 2069/062* (2013.01); *A63B 2069/064* (2013.01); *A63B 2210/50* (2013.01); *A63B 2225/09* (2013.01)

(58) Field of Classification Search

CPC ... A63B 22/0076; A63B 21/154; A63B 69/06; A63B 21/153; A63B 21/00192; A63B 21/4035; A63B 22/0087; A63B 2225/09; A63B 2069/062; A63B 2022/0079; A63B 2210/50; A63B 2069/064

See application file for complete search history.

(56) References Cited

U.S. PATENT DOCUMENTS

| | | | | |
|---|---|---|---|---|
| 4,940,227 | A * | 7/1990 | Coffey | A63B 22/0076 482/73 |
| 5,820,528 | A * | 10/1998 | McAndrew | A63B 21/154 482/72 |
| 9,005,086 | B1 * | 4/2015 | O'Neil | A63B 22/0076 482/51 |
| 2011/0275489 | A1 * | 11/2011 | Apau | A63B 21/0087 482/73 |
| 2013/0225375 | A1 * | 8/2013 | Lumsden | A63B 22/0076 482/72 |
| 2016/0001123 | A1 * | 1/2016 | Parrish, Jr. | A63B 22/0076 482/72 |
| 2016/0279464 | A1 * | 9/2016 | Liu | A63B 22/0076 |
| 2017/0266488 | A1 * | 9/2017 | Chuang | A63B 21/153 |

* cited by examiner

*Primary Examiner* — Sundhara M Ganesan

(74) *Attorney, Agent, or Firm* — Anatoly S. Weiser, Esq.; IPLCounsel.com

(57) ABSTRACT

A multi-functional rowing exerciser apparatus accommodates a plurality of rowing and paddling by connecting or releasing a cable system to selectively configure the rowing exerciser for sweep rowing, sculling oar rowing configuration to the Stand-Up-Paddling configuration in an easy and convenient manner.

21 Claims, 25 Drawing Sheets

75
73
74
77
72
70
80

MULTI-FUNCTIONAL EXERCISE ROWER

CROSS-REFERENCE TO RELATED APPLICATIONS

This application claims priority from U.S. Provisional Patent Application Ser. No. 62/363,661, entitled MULTI-FUNCTIONAL EXERCISE ROWER, filed on 18 Jul. 2016, which provisional application is incorporated herein by reference in its entirety, including text, figures, claims, tables, and all other matter.

FIELD OF THE INVENTION

This document generally relates to the field of exercise and fitness rowing equipment apparatuses, systems, and methods. More particularly, this document relates to multi-functional rowing exercisers.

BACKGROUND

Rowing simulators or machines have been known for many decades. They are used for both general strength and fitness training, and for competitive and other rowers to practice rowing indoors. Traditional indoor rowing machines come in two primary types: sweep rowers and scull rowers. In recent years, paddle-based on-water sports have experienced significant growth in interest, popularity, and participation. Such paddle-based sports include Kayaking, Canoeing (Canoe Sprint/Outrigger Canoeing/Dragon Boat), and Standup Paddle Boarding. Most paddle-based on-water sports use either a sweeping or sculling stroke that can be simulated. Thus, a number of rowing machines or rowers have been introduced to simulate and bring indoors those activities.

Sweep rowing machines have a single handle attached to a cord, cable, or chain, and a tensioning device whereby the user pulls the handle while pushing out with the user's legs in one direction, and then compresses the legs and allows the cable or chain to retract back into the tensioning device in the opposite direction. For convenience, "cable" may be used in this disclosure to refer to cord, cable, chain, ribbon, and similar flexible devices for transmitting pulling force/tension. The cable is spooled around a spindle on a wheel attached with a one-way sprocket to the resistance device/mechanism. A rowing stroke or pulling motion on the handle causes the cable spindle wheel to spin and unwind from the spool, thereby rotating the resistance device. On the opposite direction stroke, the one-way sprocket allows the spindle to rotate in the opposite direction to retract the cable, without affecting the rotation of the resistance system.

Sculling type indoor rowers have dual independent oar handles whereby the user can independently pull one or the other of the ore handles, or both ore handles together. Sculling type indoor rowers are generally implemented using gas compression cylinders as the resistance system, and are typically very simple and compact in construction. Many known indoor rowers have a slidable seat mounted to a rail so as to simulate the sliding motion of a seat in a rowing boat and allow the user to extend and retract legs in the course of exercising. When the user is seated on the sliding seat, the user places his or her feet on the footrests, which are attached to the frame upon which the seat slides. The tensioning device is generally one or a combination of known air, magnetic, flywheel, or water resistance devices. Many rowers allow the user to increase or decrease the level of resistance.

Known indoor rowers also may have a variety of sensors that capture performance metrics of the user during the use of the rowers, and present the metrics on a visual display or console. The data may also be stored in a memory for comparing against other workout sessions. Some consoles also include wireless data transmitters that allow sharing of performance data with other devices.

Stand-up paddle (SUP) boarding is a paddle-based on-water sport that continues to gain popularity. The SUP paddleboard stroke benefits athletes with a strong core workout. Paddle boarding requires strength in the arms, the abdomen and the legs, which must stay engaged to perform the SUP stroke and to maintain balance to keep the board from tipping. It is desirable that athletes have some ability to practice the paddleboard stroke when there is no access to a water venue. Known SUP simulators include those that recreate the SUP paddling stroke; these apparatus are stand-alone and do not allow for simulating other types of paddle-based on-water sports.

If a user desires to practice indoors multiple types of rowing techniques, the available choices are rather limited. Known systems generally allow for a single rowing type, and the user needs to purchase multiple types of rowing machines and move from one machine to another. This requires investment in multiple machines, increased machine maintenance costs, and may be prohibitive because of the space requirements of multiple machines.

SUMMARY

Therefore, a need in the art exists for apparatus and associated techniques for accommodating a plurality of rowing simulation styles in a single apparatus. A need in the art also exists for compact, reliable, multi-functional rowing exercise machines.

Embodiments, variants, and examples described in this document are directed to apparatus and methods that may satisfy one or more of the above described needs and/or other needs. Select examples show apparatus that provide realistic simulation of a plurality of rowing techniques.

Disclosed embodiments include a multi-functional exercise apparatus for simulating a plurality of paddle-based and/or oar-based on-water sports. Disclosed embodiments include apparatus that simulates sweep rowing using a sweep rowing handle, sweep rowing using a single side oar, dual oar sculling, stand-up paddle board rowing, and canoeing. Disclosed embodiments include multi-functional rowers with common resistance systems.

In an embodiment, a multi-functional exercise rower includes a frame; a rail attached to the frame; a seat slidable on the rail, the seat being selectively lockable on the rail; a resistance system attached to the frame; a primary shaft; a resistance system one-way device (such as a one-way sprocket or a one-way bearing) attaching the primary shaft to the resistance system; a first foldable oar attached to one side of the frame and a second foldable oar attached to another side of the frame; a main rigging support attached to the frame; an articulating rigging support attached to the rail or to the frame and configured to pivot from side to side; a first cable comprising a first end of the first cable and a second end of the first cable; a first fastener (releasable or not releasable) configured to couple selectively the first end of the first cable to at least one first item adapted to be pulled by a user of the multi-functional exercise rower in the course of the user's exercising; a second cable comprising a first end of the second cable and a second end of the second cable; a second fastener (releasable or not releasable) configured to couple the first end of the second cable to a paddle; a first transmission mechanism configured to operate the resistance system when the user pulls on the at least one first item when the at least one first item is coupled with the first fastener to the first end of the first cable, wherein the first transmission mechanism guides the first cable through the main rigging support; and a second transmission mechanism configured to operate the resistance system when the user pulls on the paddle when the paddle is coupled with the second fastener to the first end of the second cable, wherein the second transmission mechanism guides the second cable through the articulating rigging support.

In an embodiment, a multi-functional exercise rower includes a frame; a rail attached to the frame; a seat slidable on the rail, the seat being selectively lockable on the rail; a resistance system attached to the frame; a primary shaft; a resistance system one-way device (such as a one-way sprocket or a one-way bearing) attaching the primary shaft to the resistance system; a first foldable oar attached to one side of the frame and a second foldable oar attached to another side of the frame; a main rigging support attached to the frame; an articulating rigging support attached to the rail or to the frame and configured to pivot from side to side; a first cable comprising a first end of the first cable and a second end of the first cable; a first fastener (releasable or not releasable) configured to couple selectively the first end of the first cable to at least one first item adapted to be pulled by a user of the multi-functional exercise rower in the course of the user's exercising; a second cable comprising a first end of the second cable and a second end of the second cable; a second fastener (releasable or not releasable) configured to couple the first end of the second cable to a paddle; a first transmission means for operating the resistance system when the user pulls on the at least one first item when the at least one first item is coupled with the first fastener to the first end of the first cable; and a second transmission means for operating the resistance system when the user pulls on the paddle when the paddle is coupled with the second fastener to the first end of the second cable.

These and other features and aspects of selected embodiments, variants, and examples consistent with the present disclosure will be better understood with reference to the following description, drawings, and appended claims.

BRIEF DESCRIPTION OF THE FIGURES

Embodiments will be described in detail with reference to the accompanying drawings. Like references indicate same elements in the description and the drawings.

DETAILED DESCRIPTION

The words "embodiment," "variant," "example," and similar words and expressions as used here refer to a particular apparatus, process, or article of manufacture, and not necessarily to the same apparatus, process, or article of manufacture. Thus, "one embodiment" (or a similar expression) used in one place or context may refer to a particular apparatus, process, or article of manufacture; the same or a similar expression in a different place or context may refer to a different apparatus, process, or article of manufacture. The expression "alternative embodiment" and similar words and phrases are used to indicate one of a number of different possible embodiments, variants, or examples. The number of possible embodiments, variants, or examples is not necessarily limited to two or any other quantity. Characterization of an item as "exemplary" means that the item is used as an example. Such characterization does not necessarily mean that the embodiment, variant, or example is a preferred one; the embodiment, variant, or example may but need not be a currently preferred embodiment, variant, or example. All embodiments, variants, and examples are described for illustration purposes and do not necessarily strictly limit the invention(s) disclosed.

A "one-way device" refers to a one-way sprocket or a one-way bearing (such as a clutch bearing) or analogous type of ratcheting mechanism.

The terminology used herein is for the purpose of describing particular embodiments only and is not necessarily intended to be limiting of the invention(s). As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention pertains. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

Some definitions have been explicitly provided above. Other and further explicit and implicit definitions and clarifications of definitions may be found throughout this document.

Figure 1:
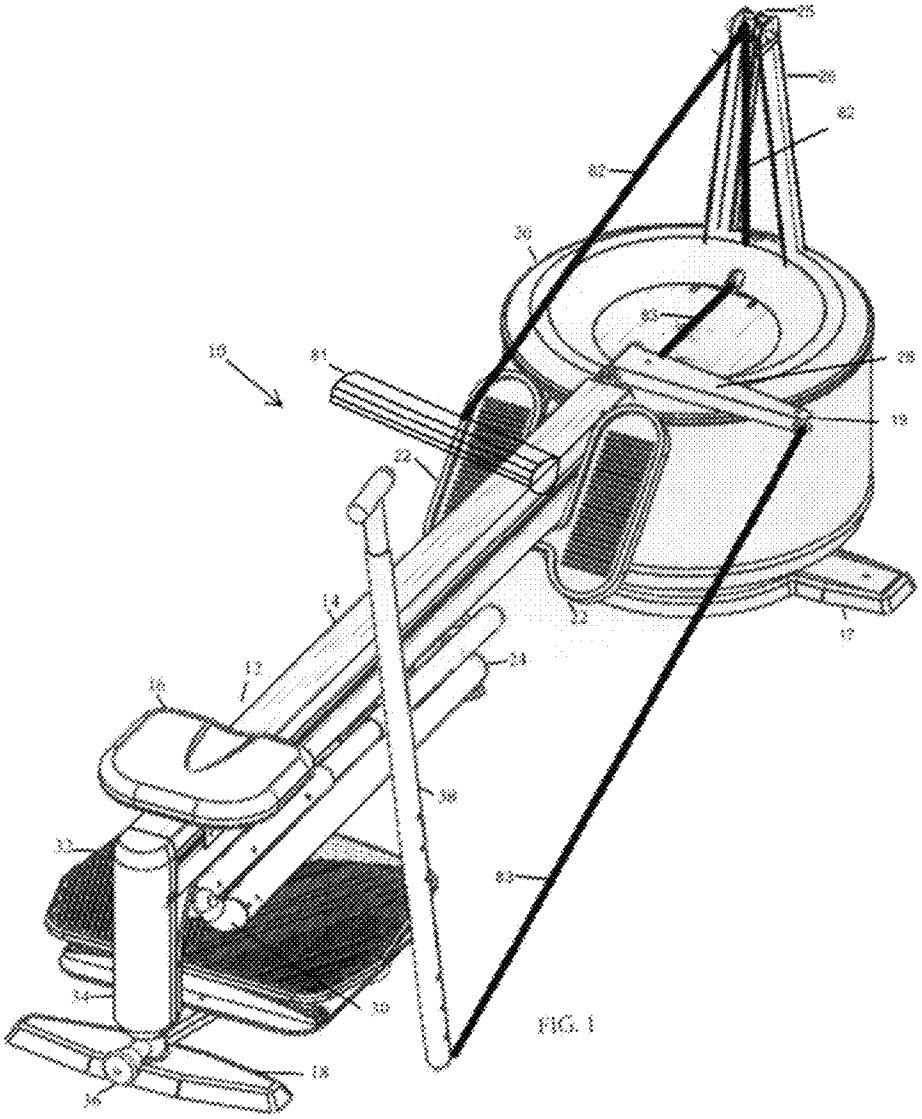
FIG. 1 is a perspective view of an embodiment of an exercise apparatus in accordance with selected aspects of this disclosure.

FIG. 1 is a perspective view illustrating selected components of a multi-functional exercise rower 10. The rower 10 includes a frame 12 with a rail 14; a front cross beam foot 17; and a rear cross beam foot 18. The rower 10 also includes a housing 20 that houses various tensioning, retraction, and cable rigging components, as well as a resistance system. The rower 10 further includes a main rigging support 26 and an articulating rigging support 28 that assist in properly guiding actuating cables as the cables are pulled out by the user and then retract into the tensioning system within the housing 20. The main rigging support 26 includes a guide wheel 25 on a spindle at the top (as shown in the orientation of FIG. 1) of the main rigging support 26, to maintain the position of a first cable 82 and allow the user to pull on a sweep row handle 81 or sculling oars 24 (one of which oars is shown in inactive, folded state in FIG. 1, with the other one symmetrically positioned on the other side of the rail 14). The sweep row handle 81 or the sculling oars 24 attach to the end of the first cable 82 so that the first cable 82 moves through a first portion of the rigging system and activates the resistance system inside the housing 20. The first portion of the rigging system may also be referred to as a "first transmission mechanism." Attachments of cables to change configuration/mode of the rower 10 here and other rowers described elsewhere throughout this document may be performed using a fastener, such as a clip or a carabiner, or any other type of releasable or non-releasable fastener; adjusting cables may also be used to create cable length proper for a given mode and/or a given user and the user's preferences.

The articulating rigging support 28 includes a guide wheel/spindle combination 19 generally at its end (away from the rail 14) to maintain the position of a second cable 83 as the second cable 83 moves through a second portion of the rigging system, activated by the user while the rower 10 is in canoeing or SUP paddling mode. The second cable 83 is attached to one end of a SUP oar 38 with a releasable or non-releasable cable attachment, turns around the guide wheel 19 at the end of the articulating rigging support 28, travels inside the articulating rigging support 28 to another guide wheel at the other end of the articulating rigging support 28 (near the rail 14) and turns around the other guide wheel to travel towards the front of the rower 10, entering the housing 20. The rigging support 28 is "articulating" in the sense that it easily pivots from side to side of the rail 14.

FIG. 1 shows attachment of the sweep row handle 81 and the SUP oar 38 for illustration, though in practical use the user would likely employ a single configuration/mode at a time.

A position-adjustable seat 16 for supporting the user of the rower 10 slides on the rail 14, and may be selectively locked in place. Foot supports 22 on each side of the rail 14 are attached to the frame 12 and/or to the rail 14, and are designed to receive and support the user's feet. (The rail 14 may serve as the frame 12 at the same time.) The seat 16 may include a roller system that allows the seat 16 to slide fore and aft on the rail 14 with little resistance. The sculling oars 24 are mounted on the frame 12, one (or more) on each side of the frame. As has already been mentioned, only one sculling oars 24 is shown in the view of FIG. 1, but an analogous sculling oar mutatis mutandis is located on the other side of the rail 14. The oars 24 may be made of one or more sections attached with hinge(s) 30 and, when not in use, may be folded for easy storage under the rail 14 or the frame 12. Each section of the sculling rower handle may be telescoping and include one of many types of locking mechanisms known in the art to maintain a length that is suitable to the user's size and comfort preference. It is contemplated that a second housing (in addition to the housing 20) can be constructed about the frame 12 to house the sculling oars 24.

A standup paddle board simulation platform 32 is attached towards the rear of the frame 12. The SUP platform 32 is pivotably rotatable about a frame upright support 34, which allows the SUP platform 32 to be in a deployed positioned during use, and stowed under the frame during non-use. In FIG. 1, the SUP platform 32 is shown in a stowed position. In the deployed position, the SUP platform 32 would be rotated around the frame upright support 34 and protrude at the rear of the rower 10. (We consider the rear of the rower 10 to be generally near the rear cross beam foot 18 and the frame upright support 34, and the front to be generally near the housing 20 and the main rigging support 26.) A locking device 36 fixes the SUP platform in place when stowed or deployed. The locking device 36 can be any of many known locking mechanisms, for example, a pop pin.

The long simulated SUP oar 38 may have a telescoping tube-in-tube design with a spring-loaded pin-in-hole locking mechanism, to allow for adjustment of its length. The SUP oar 38 includes a cross bar handle on one end (at the upper end as shown in FIG. 1) to facilitate rowing motions by the user. At the opposite end, the SUP oar 38 has a cable attachment device, to allow removable attachment to the end of the second cable 83, which runs through the second portion of the rigging system and is attached to the resistance system inside the housing 20. The second portion of the rigging system may also be referred to as a "second transmission mechanism." In this way, variable resistance is provided by the resistance system in the SUP mode. The articulating rigging support 28 can rotate from side to side (relative to the frame 12) as the user moves the SUP oar 38 from side to side, allowing for a realistic simulation of oar strokes through water on each side.

Figure 2:
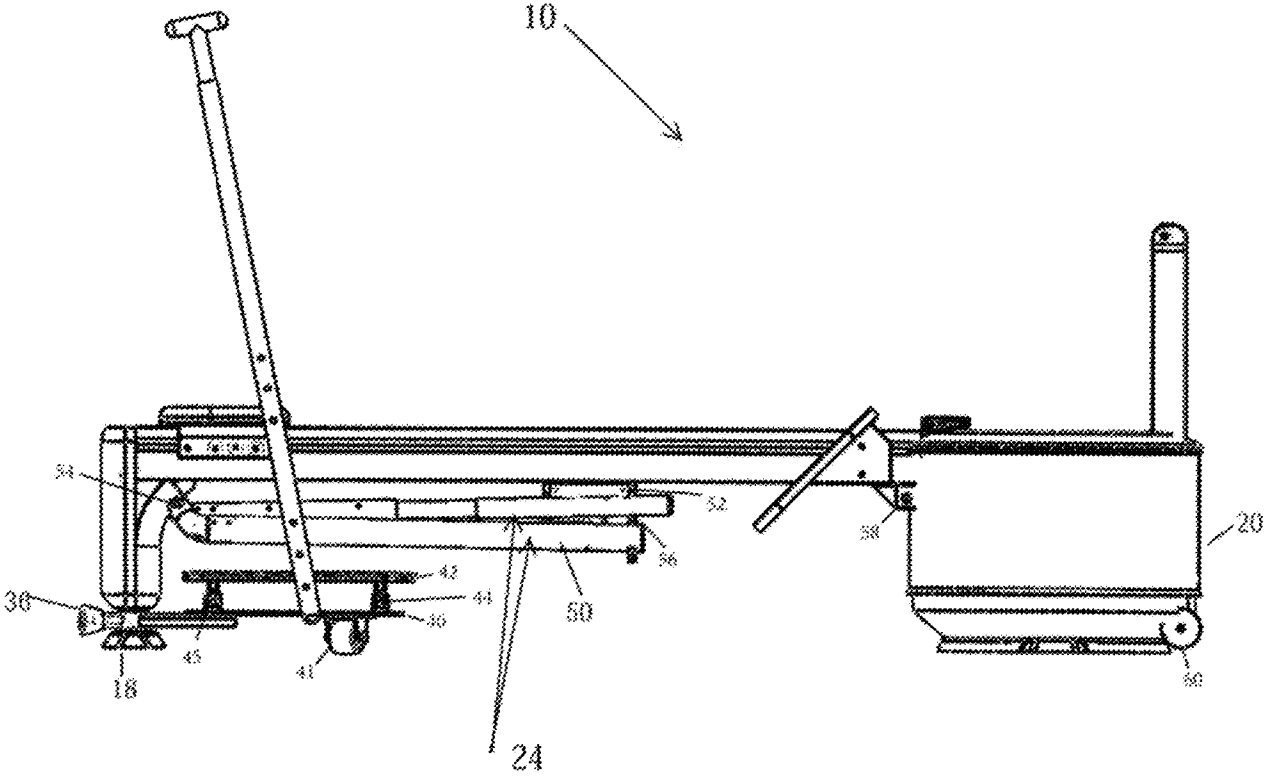
FIG. 2 is a first side plan view of the exercise apparatus of FIG. 1.

FIG. 2 shows a side profile of the rower 10. In this view, the SUP platform 32 is detailed as including a base member 40 and an upper member 42. The base member 40 is attached to the rear cross beam foot 18, to a wheel 41, and to the locking device 36. When the locking device 36 is released from the lock position, the SUP platform 32 can be repositioned from a stowed position (as shown in FIG. 2) to a deployed position, by pivoting the SUP platform base member 40 about the rear cross beam foot 18 towards the rear of the rower 10. The wheel 41 both supports the SUP platform 40 during use and facilitates rotation of the SUP platform 32 from stowed position to the deployed position and back.

We contemplate that a number of alternative configurations can replace the wheel 41; for example, a fixed rigid sliding support or similar known support mechanisms may be used.

The upper member 42 is supported on the base member 40 by one or more compressible support members. In the embodiment of FIG. 2, two compressible support members 44 and 45 are shown, each of which is a springed, arc-shaped support member. In this embodiment, the upper member 42 can tilt approximately 20-30 degrees along the arc from the horizontal orientation (for a typical user weight of up to 350 pounds). The velocity of tilt can be controlled by the spring tension or the density of rubber or other elastic materials that is used for the compressible support members. The compressible support members provide for limited flexing of the upper member 42, such that the user experiences movement of the upper member 42 of the platform 32 in a manner that simulates the movement of a standup paddle board as it floats on the water. There may be a number of configurations of compressible support members such as a single or multiple inflated bladders, single or multiple compression springs, and solid rubber (or similar flexible material) moldings. Other compressible supports are contemplated as well.

FIG. 2 also shows one of the two sculling oars 24 in a stowed position. The sculling oar 24 is movably attached to the frame 12 by a bracket 52 and a pivot pin 56. When deployed during use, the scull rowing oar arm 50 is extended by a tension hinge 54 that allows the arm to articulate or move in a scull rowing motion. Creating a rowing resistance in the sculling oar handles can be implemented in a number of ways. For example, the scull oar arms are connected to the first cable 82 and the first transmission mechanism by using a fastener clip to attach the first cable 82 to the sculling oar 24. When the oar is pulled, the cable is drawn from the resistance system, creating resistance. This simulates the power stroke of a real oar in the water. In variants, hydraulic or gas compression canisters or rubber tension bands are attached to the sculling oar 24 to create resistance independent of or in addition to the resistance provided by the resistance system in the housing 20.

When the system is not in use, it is preferable that the foot print of the system be small for easy storage in a small space. FIG. 2 shows a frame pivot joint 58 and a housing wheel 60. The frame pivot joint 58 connects the rail 14 with the housing 20. The user can release the joint 58 and bring the rail 14 from a horizontal plane during use to a vertical plane during non-use. When the joint 58 locks the rail 14 in a vertical position the footprint of the rower is substantially the same as the footprint of the housing 20. The rower can then be easily transported using the housing wheel 60, by tilting the vertically locked rail 14 and pushing on some part of the rower 10.

Figure 3:
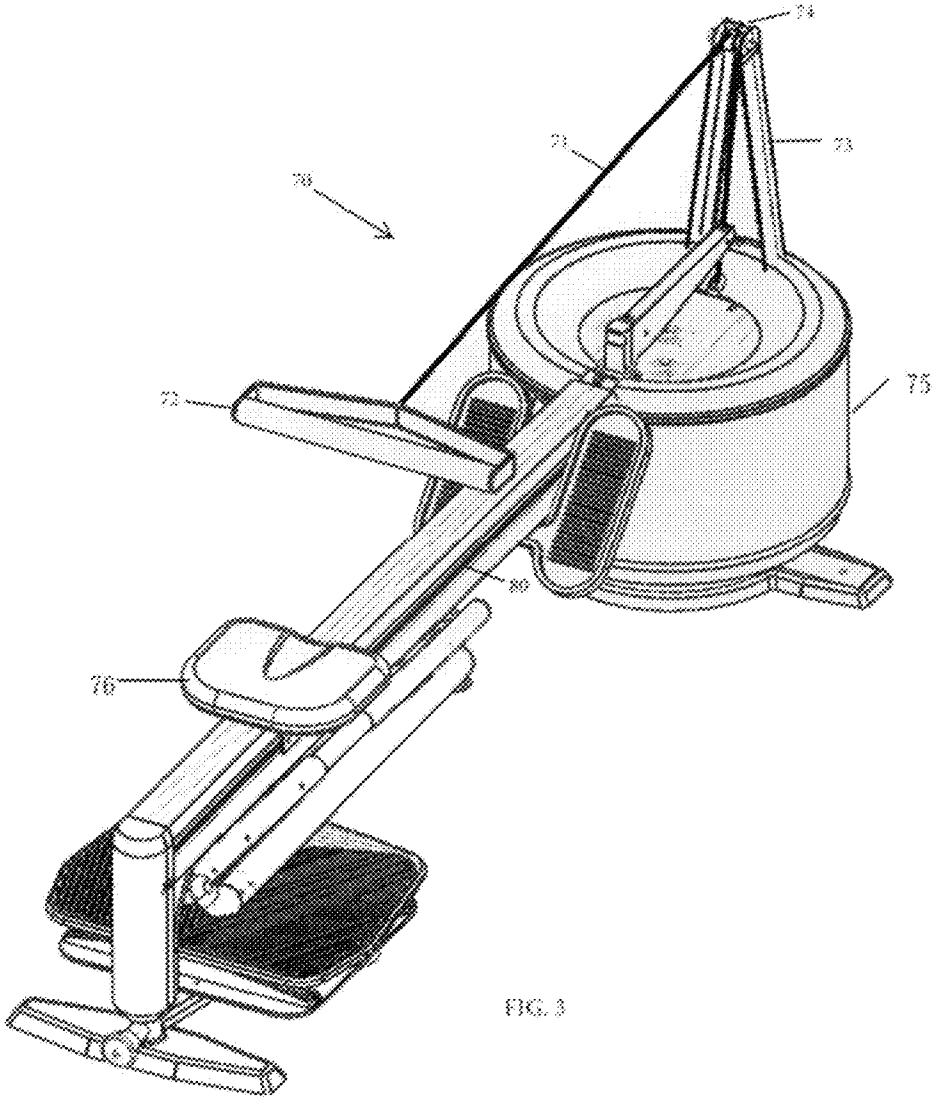
FIG. 3 is a perspective view of an embodiment of exercise apparatus with a single handle sweeping configuration, in accordance with selected aspects of this disclosure.
Figure 4:
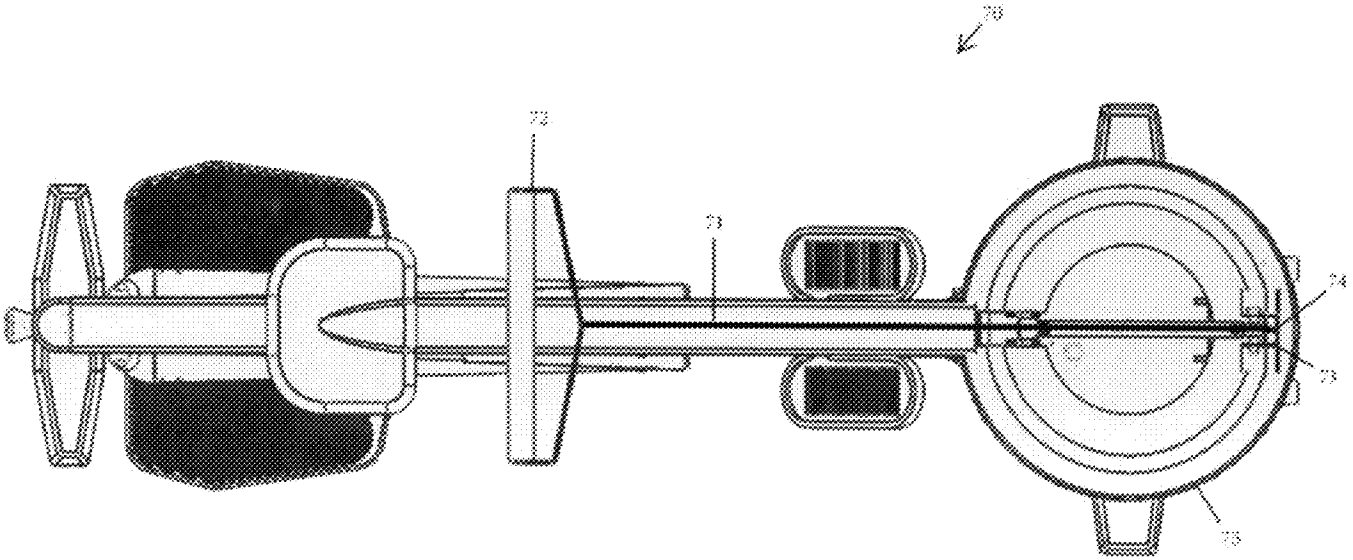
FIG. 4 is a top down plan view of the exercise apparatus of FIG. 3.

FIGS. 3 and 4 illustrate a rower 70 in a configuration for sweep rowing motion. One end of a cable 71 is attached to a sweep row handle 72 using a fastener, such as a clip or carabiner. It is contemplated that any type of releasable or non-releasable fastener can be used for this attachment. The cable 71 is routed over a pulley wheel 74, down the rigging support 73; the other end of the cable 71 is attached to the resistance system inside the housing 75. A seat 76 slides on a rail 80.

Note that the top down view of the rower 10 (described in connection with FIGS. 1 and 2) in the sweep rowing configuration resembles the top down view of the rower 70 (FIG. 4), but would also include the articulating rigging support 28 extending from the front of the rail to one of the sides.

Figure 5:
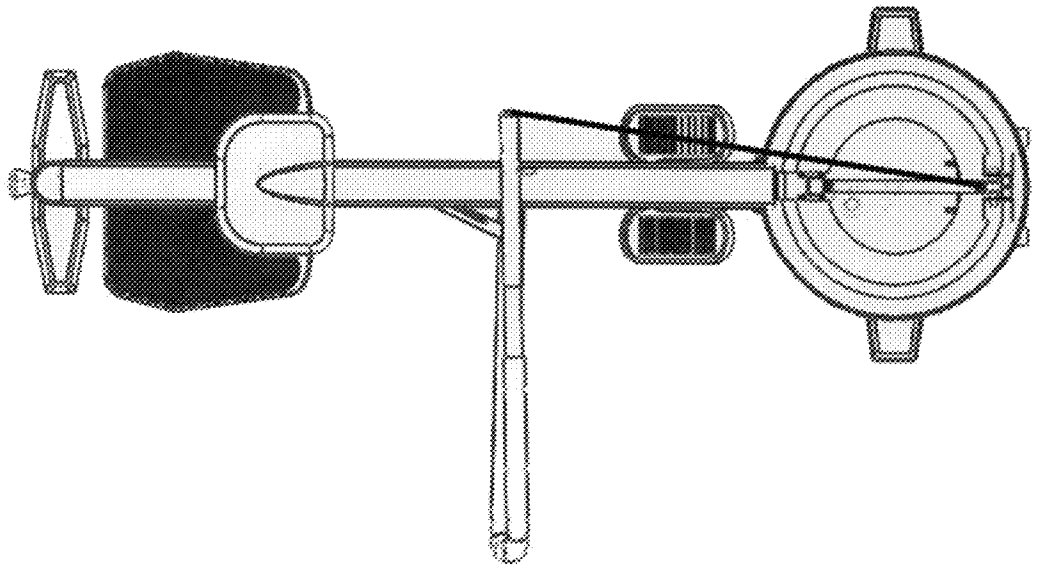
FIG. 5 is a top down plan view of an exercise apparatus in a single side handle oar rowing configuration, in accordance with selected aspects of this disclosure.
Figure 6:
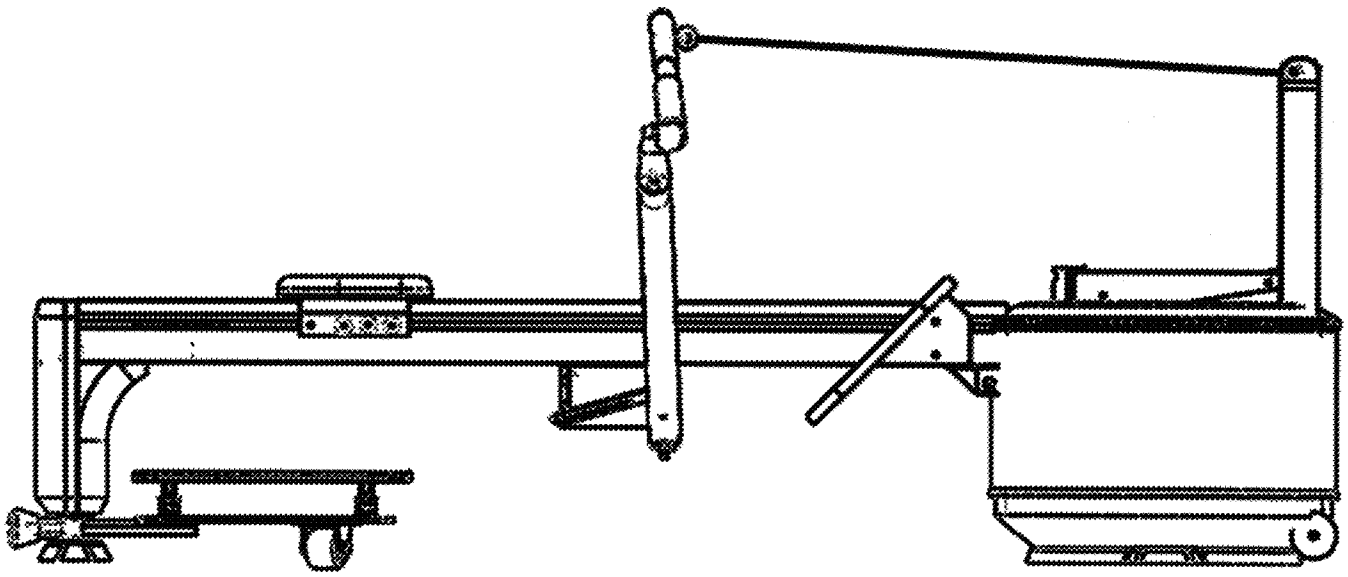
FIG. 6 is a side plan view of the exercise apparatus in a single side handle oar rowing configuration, in accordance with selected aspects of this disclosure.
Figure 7:
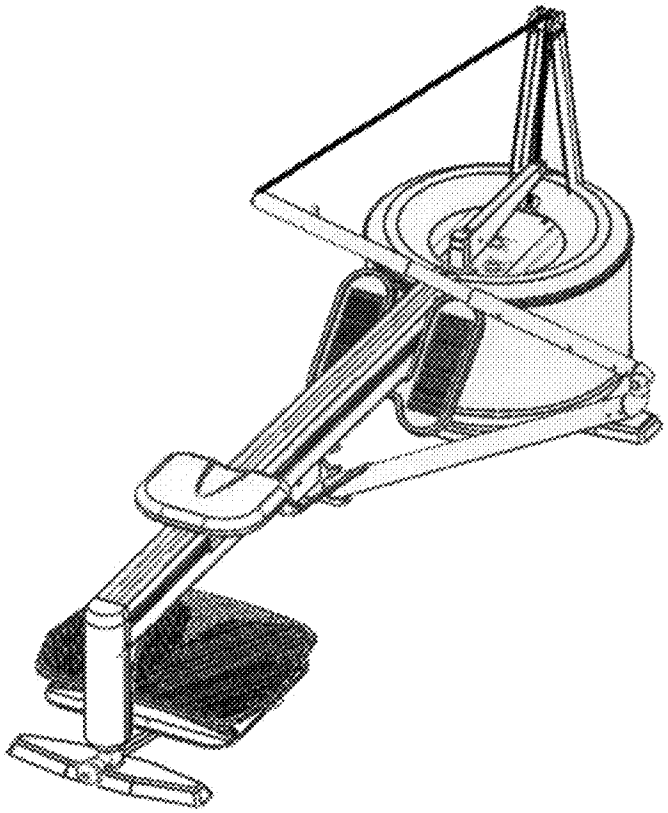
FIG. 7 is a perspective view of the exercise apparatus with a single side handle oar rowing configuration, in accordance with selected aspects of this disclosure.

FIG. 5 is a top down view, FIG. 6 is a side view, and FIG. 7 is a perspective view of a sculling oar rower in the deployed position. It is contemplated that the sculling oar handle may include a rotational segment in the longitudinal axis of the oar to simulate rotation of an oar in the actual rowing environment. As in the rower 10, a second sculling oar handle is in the stowed (non-deployed) position on the other side of the rail of the rower of these Figures.

The top down view, the side view, and the perspective view of the rower 10 (described in connection with FIGS. 1 and 2) in the single oar sweep configuration/mode using one of the oars 24 resemble the corresponding views of the rower of FIGS. 5-7, but would also include the articulating rigging support 28 extending from the front of the rail to one of the sides.

Figure 8:
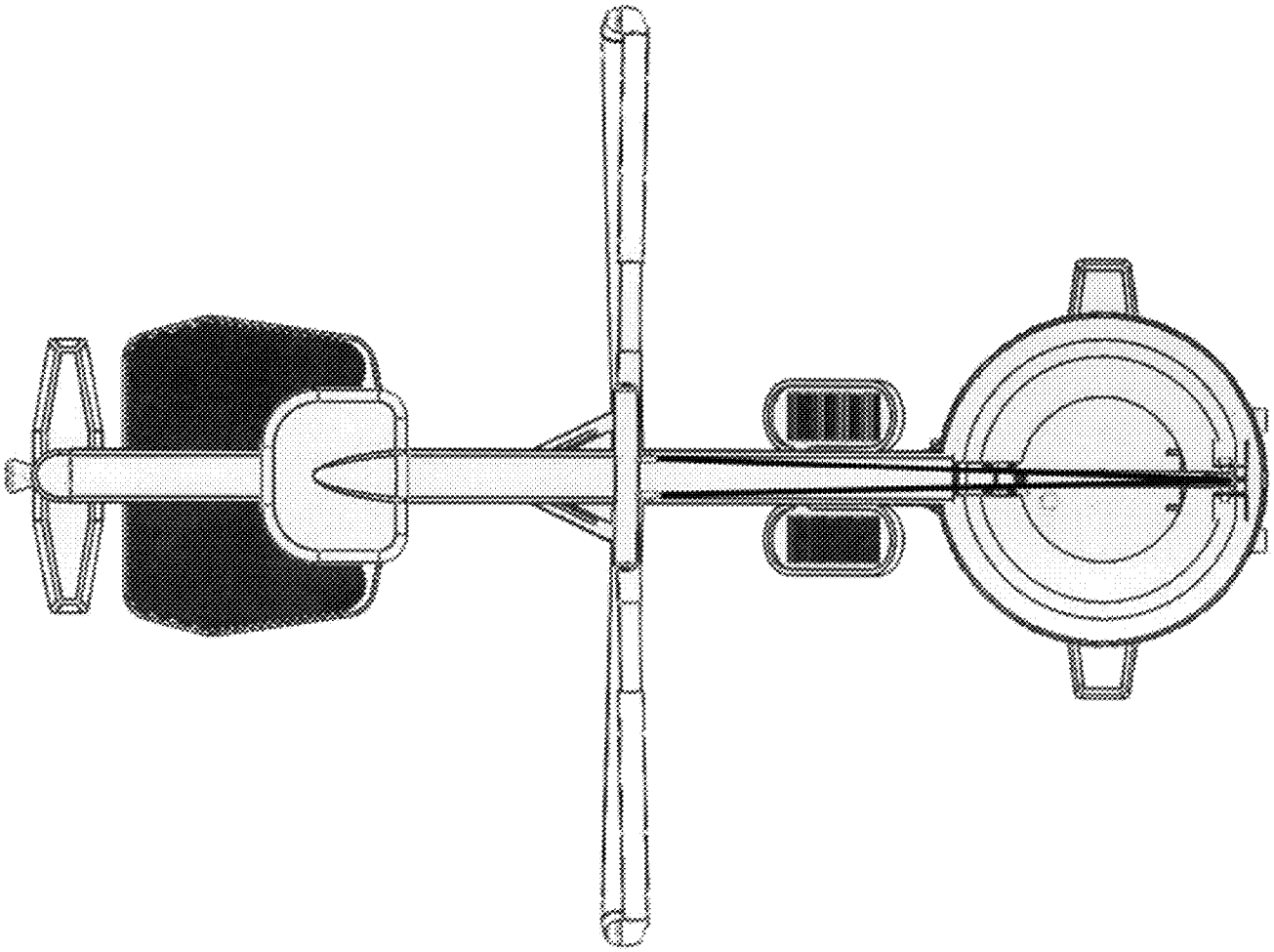
FIG. 8 is a top down plan view of an exercise apparatus in a double handle scull rowing configuration, in accordance with selected aspects of this disclosure.
Figure 9:
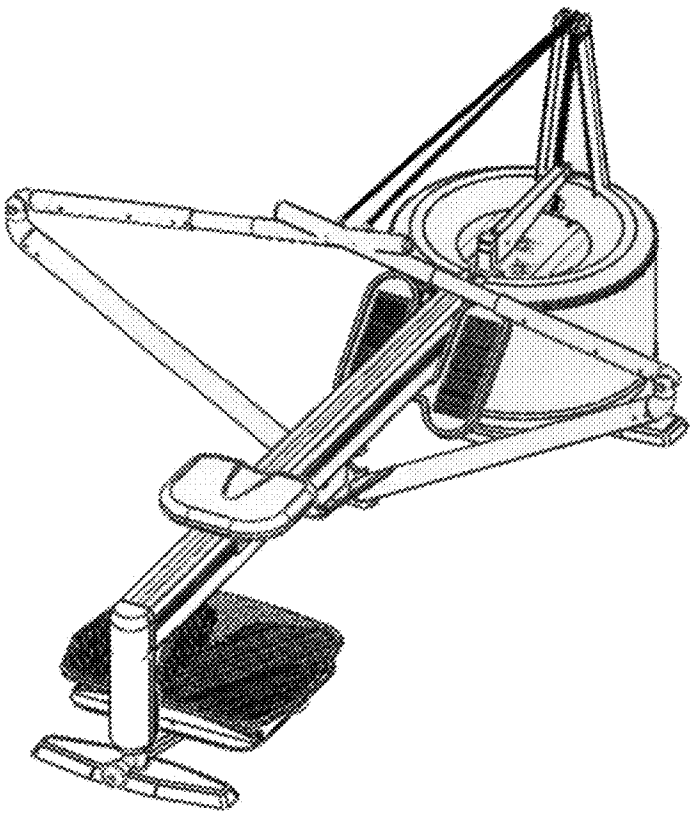
FIG. 9 is a perspective view of the exercise apparatus with a double handle scull rowing configuration, in accordance with selected aspects of this disclosure.

FIGS. 8 and 9 show both sculling oars in the deployed position, providing for dual oar rowing. Again, the rower 10 would appear in a similar way, but with the addition of the articulating rigging support 28 extending from the front of the rail to one of the sides.

Figure 10:
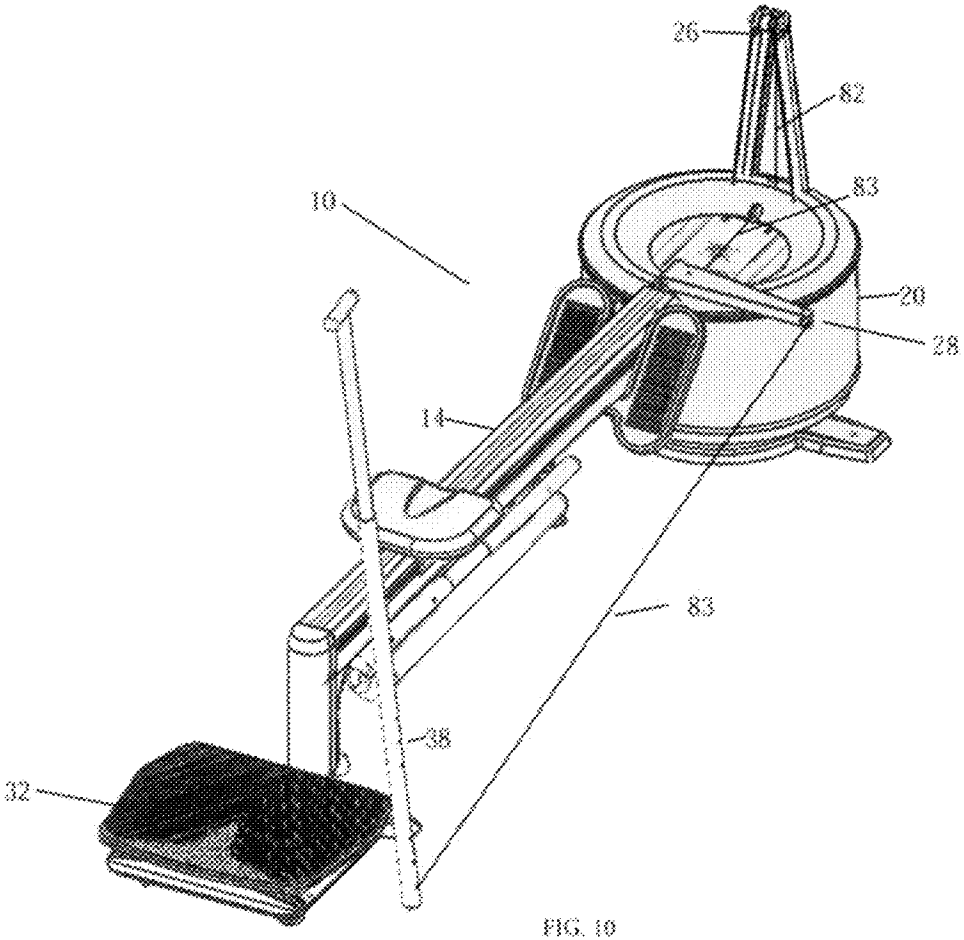
FIG. 10 is a perspective view of an exercise apparatus in a stand up paddle board rowing configuration, in accordance with selected aspects of this disclosure.
Figure 11:
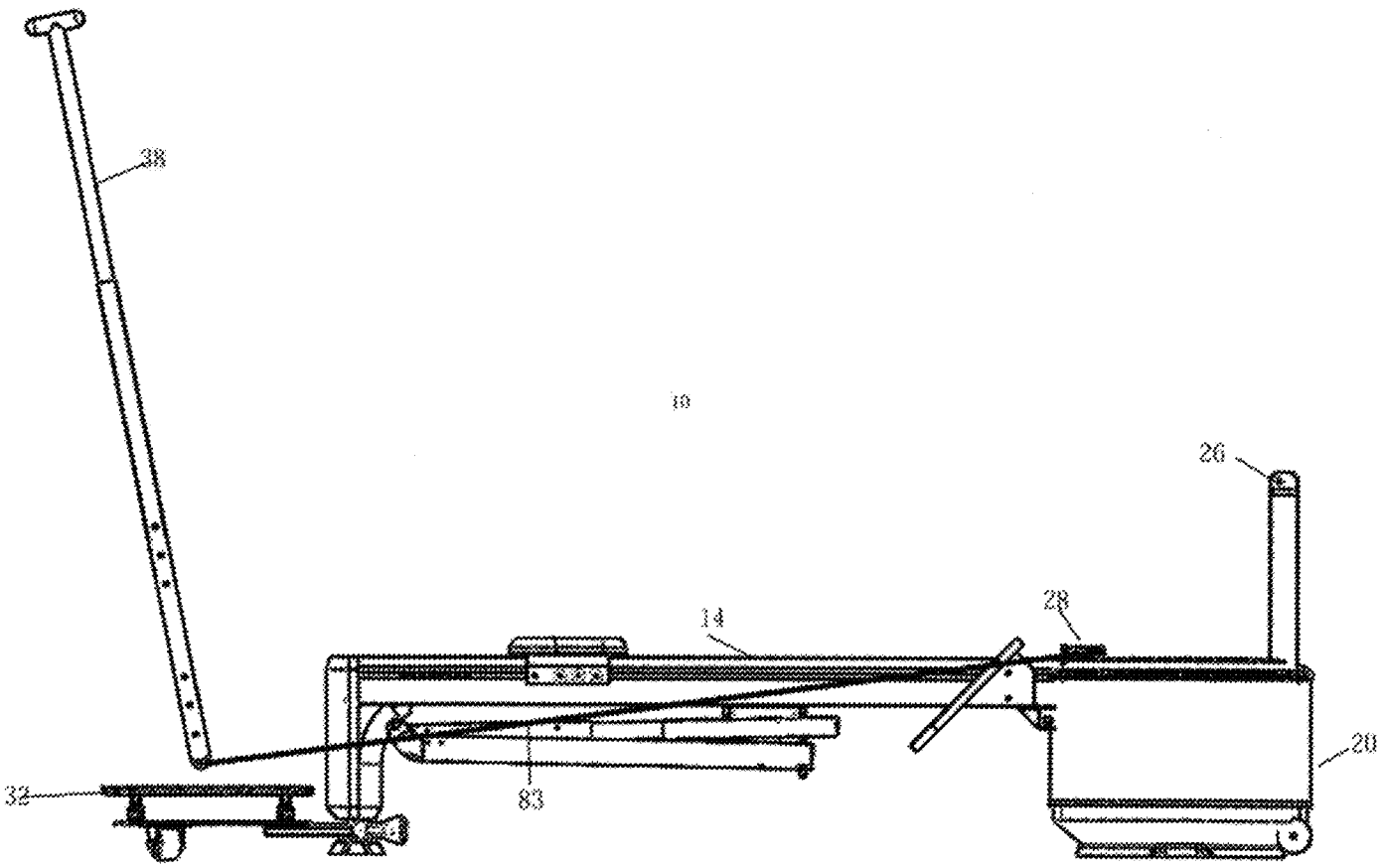
FIG. 11 is a side plan view of the exercise apparatus in a stand up paddle board rowing configuration, in accordance with selected aspects of this disclosure.
Figure 12:
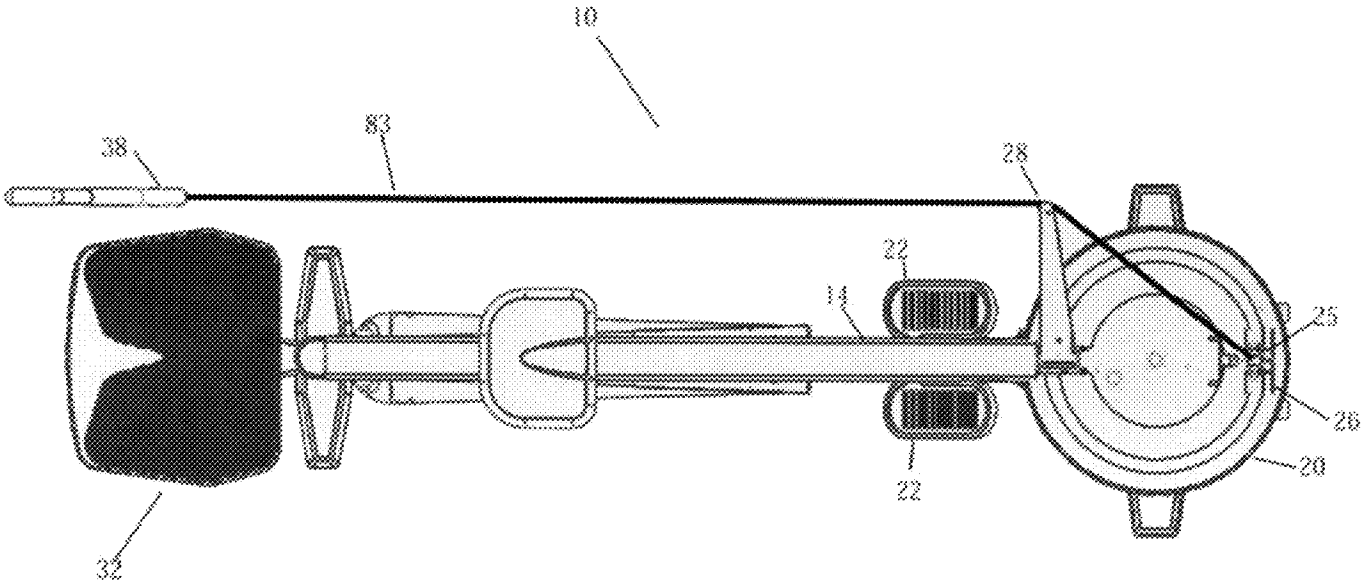
FIG. 12 is a top down plan view of the exercise apparatus in a stand up paddle board rowing configuration, in accordance with selected aspects of this disclosure.

FIGS. 10, 11, and 12 illustrate the rower 10 in the SUP rowing configuration, with the SUP platform 32 deployed at the back. FIG. 10 is a perspective view, FIG. 11 is a side profile view, and FIG. 12 is a top down view. In FIGS. 10 and 11, the SUP paddle 38 is on the right side of the rail, while in FIG. 12 it is on the left side of the rail. The user can move the SUP paddle 38 during the oar stroke from one side of the rail to the opposite side, causing the articulating rigging support 28 to rotate from one side to the opposite side while providing support to the cable 83 during the paddle stroke and maintaining the cable position in a fashion that helps to prevent tangling or mis-feed of the cable 83 during retraction of the cable 83.

Figure 13:
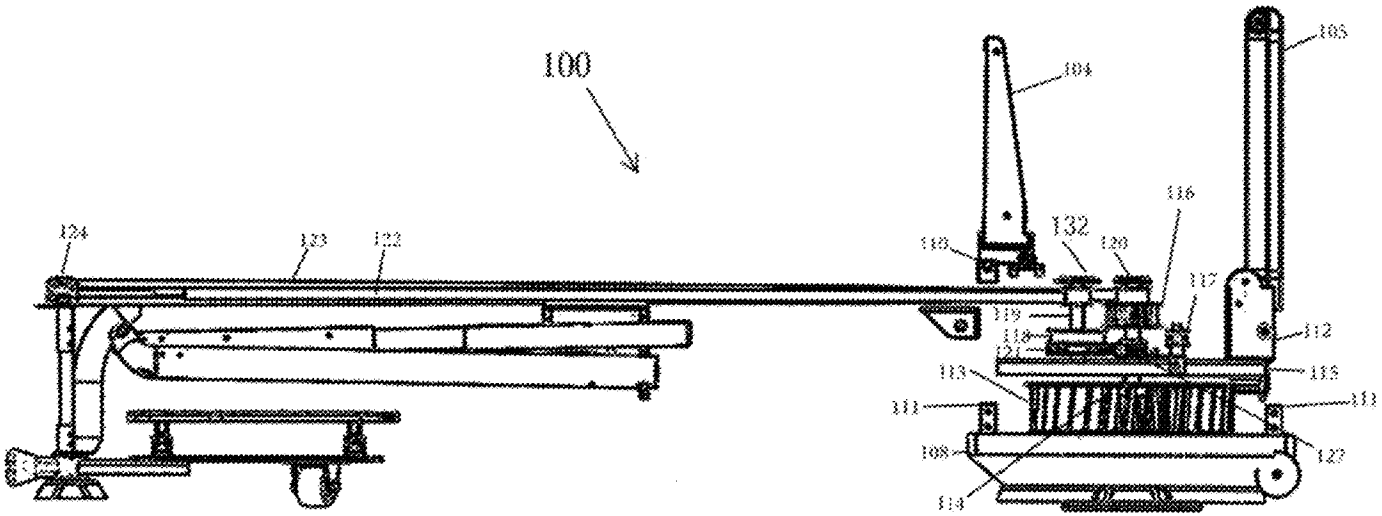
FIG. 13 is a side plan view of an exercise apparatus with the housing of the tension and retraction systems removed, in accordance with selected aspects of this disclosure.
Figure 14:
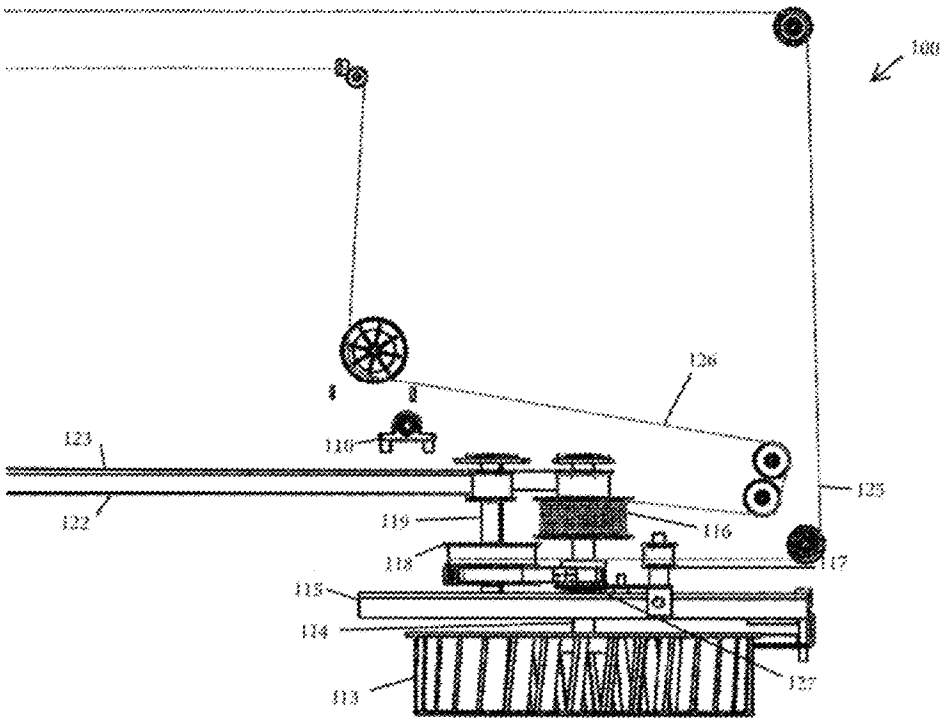
FIG. 14 is a side plan view of the pulley system of the tension and retraction system, in accordance with selected aspects of this disclosure.
Figure 15:
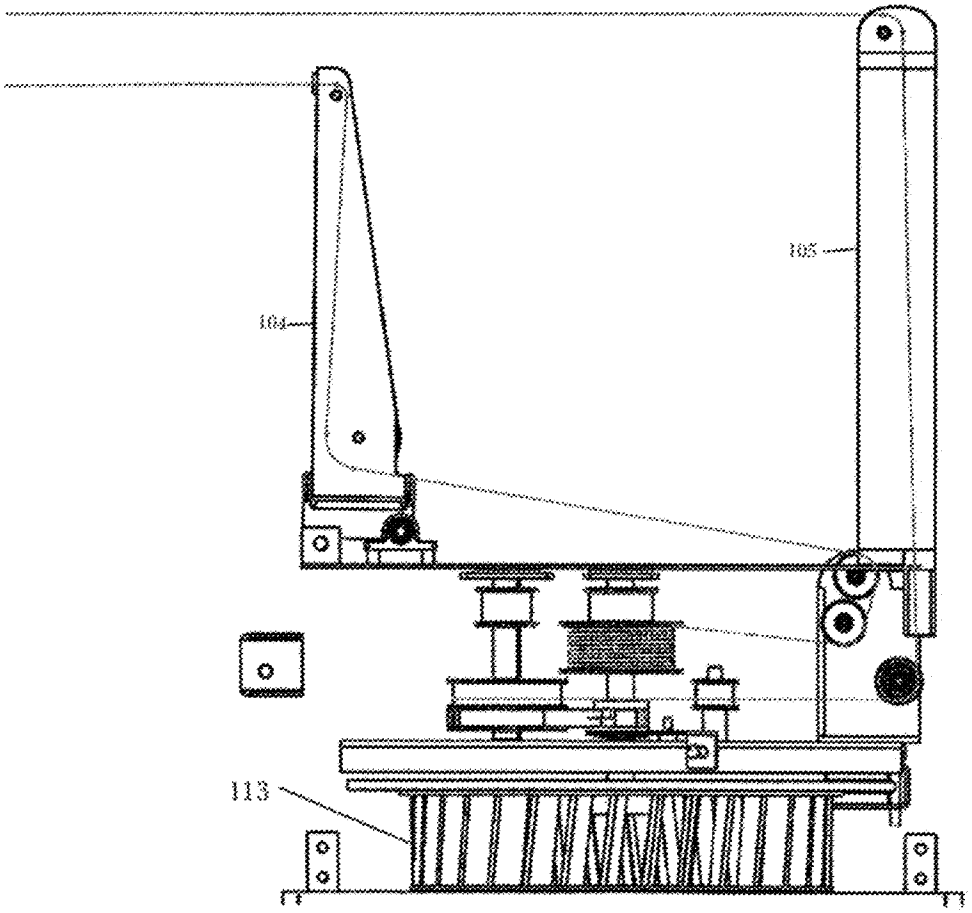
FIG. 15 is another side view of the tension and retraction system of an exercise apparatus, in accordance with selected aspects of this disclosure.
Figure 16:
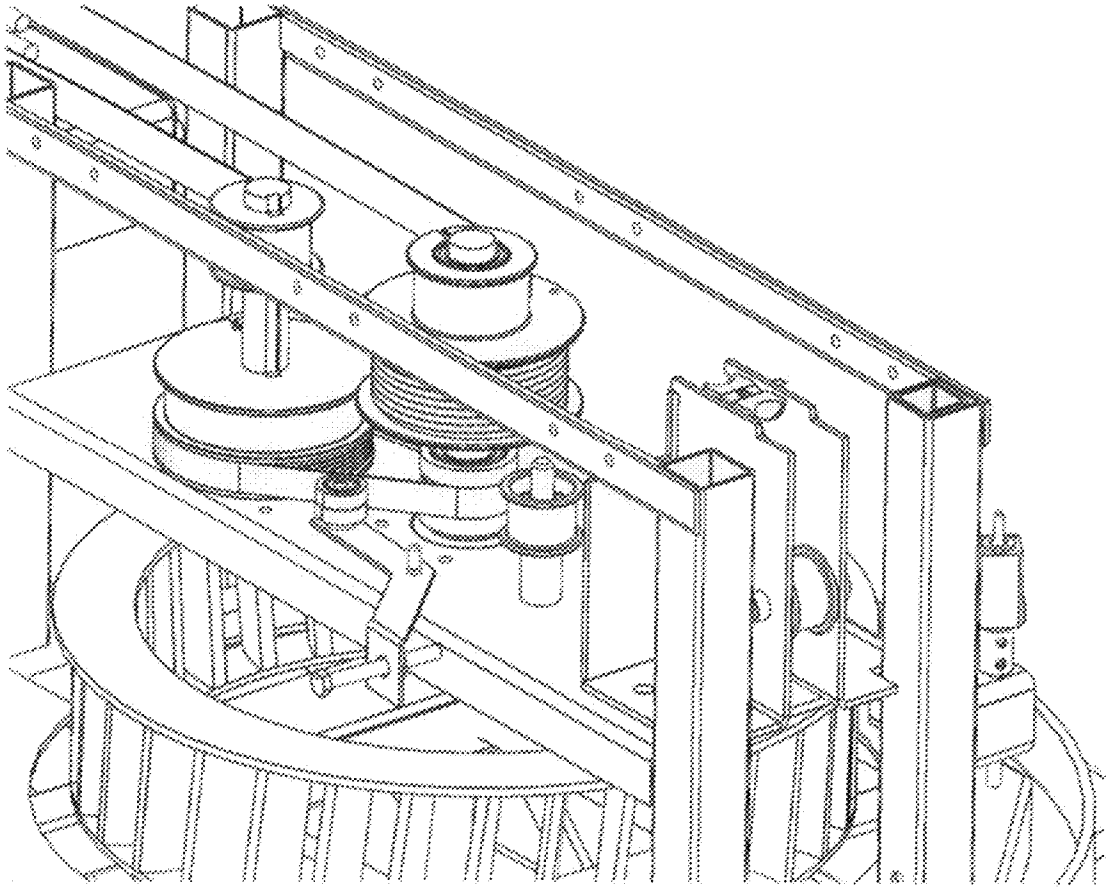
FIG. 16 is a perspective view of the tension and retraction system of an exercise apparatus, in accordance with selected aspects of this disclosure.

The rower 100 in FIGS. 13-16 is similar in many respects to the rower 10. The rower 100 is illustrated with the housing shroud removed to expose the interior including the resistance system. The housing shroud is removably secured to the base 108 by screws and screw tabs 111 during normal operation. Shown in FIGS. 13 and 15 are the articulating rigging support 104 and base rigging support 105, which are secured to the rest of the rower 100 by brackets 110 and 112. Here, resistance during the power stroke cycle is created with a carousel fan 113. The carousel fan 113 is rotatably mounted by a fan shaft 114 to the base 108 at the lower portion of the fan shaft 114. The carousel fan 113 may be a vented circular ring with a plurality of angled blades, for creating air resistance during rotation. The fan shaft 114 extends through a bracket mounting plate 115 and is fixedly attached to a primary cable reel wheel 116. The fan shaft 114 extends through and is secured by an upper mounting plate (not shown) and attached to a geared ring bearing 120 for smooth rotation and unidirectional rotation. Also shown in FIG. 13 is a secondary cable reel wheel 118 supported by a shaft 119 extending through the upper mounting plate (not shown) and associated with a second ring bearing 132. The primary cable reel 116 and secondary cable reel 118 take up and release the cable as the user goes through the forward and back stroke of sculling, sweeping, or paddling.

In a configuration using the sweep row handle, single oar, or dual oars for sweep rowing or sculling, one end of a primary cable remote from the secondary cable wheel 118 is connected to the sweep handle, single oar, or dual oar handgrips for operating by the user. The cable is supported through the rigging support 105. The other end of the cable is connected to the secondary cable reel 118. On the back stroke, the secondary cable wheel 118 rotates and unwinds the cable and engages the geared bearing to cause the carousel fan rotation to create air resistance utilizing belt 121 to connect shaft 119 to shaft 114 via the sprocket (or another one-way device) at the base secondary cable reel 118 and sprocket (or another one-way device) 127 respectively. Also during the back stroke, tension is introduced into bungee cord 122 as it is stretched and coiled by winding around a secondary pulley on the top of shaft 119 as a result of the rotation of secondary cable wheel 118. As the forward stroke occurs, the secondary cable wheel 118 is rotated in the reverse direction to take up (or to coil by winding) the cable about the secondary cable wheel 118 by the stored tension in bungee cord 122 reversing the rotation of the secondary pulley on the top of shaft 119.

In a configuration using the SUP paddle, one end of a cable remote from the primary cable wheel 116 is connected to the lower end of the SUP paddle for operating by the user. The cable is supported through the rigging support 104. The other end of the cable is connected to the primary cable reel 116. On the back stroke, the primary cable wheel 116 rotates and unwinds the cable and engages the geared bearing to cause the carousel fan rotation to create air resistance. Also during the back stroke, tension is introduced into bungee cord 123 as it is stretched and coiled by winding around a secondary pulley on the top of shaft 114 as a result of the rotation of primary cable wheel 116. As the forward stroke occurs, the primary cable wheel 116 is rotated in the reverse direction to take up (or to coil by winding) the cable about the primary cable wheel 116 by the stored tension in bungee cord 123 reversing the rotation of the secondary pulley on the top of shaft 114.

The carousel fan 113 rotation is driven by the pull of at least one of the primary cable 125 or the secondary cable 126 through a transmission mechanism that includes a one-sprocket gear (or another one-way device) 127 mounted about the fan shaft 114. The sprocket (or another one-way device) 127 is able to rotate in one direction thus rotating the fan in one direction. Rotation of the sprocket (or another one-way device) 127 in a single direction results in substantially free rotation of the sprocket (or another one-way device) 127 which allows for the take up of the cables 125 and 126.

The carousel fan 113 rotation is driven by the pull of at least one of the primary cable 125 or the secondary cable 126 through a transmission mechanism that includes a sprocket gear 127 mounted about the fan shaft 114. The sprocket 127 is able to rotate in one direction thus rotating the fan in one direction. Rotation of the sprocket 127 in a single direction results in substantially free rotation of the sprocket 127 which allows for the take up of the cables 125 and 126.

Figure 17:
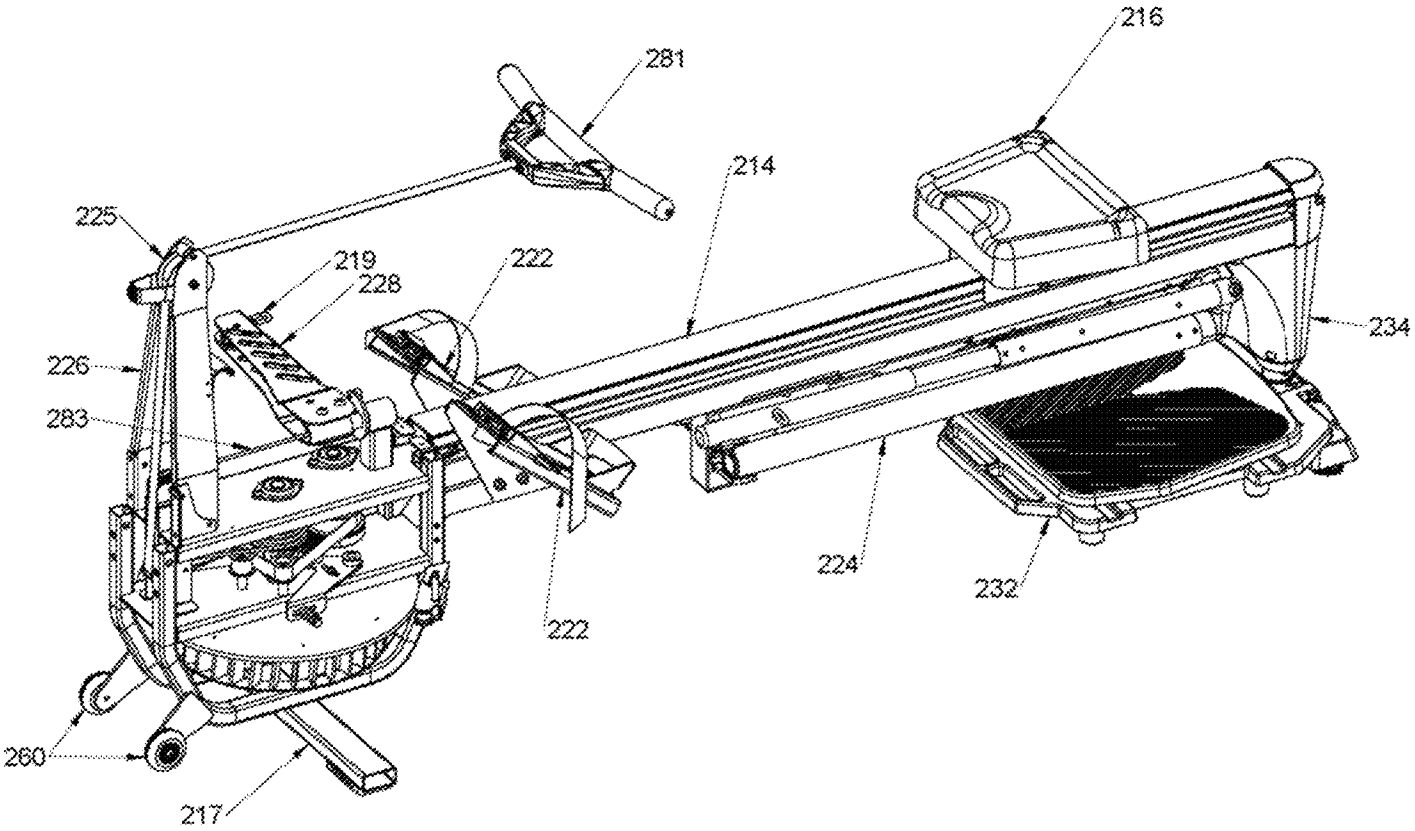
FIG. 17 is a perspective view of an exercise apparatus in accordance with selected aspects of this disclosure, with the housing shroud removed.

FIG. 17 illustrates selected components of a multi-functional exercise rower 200, shown in a perspective views with its housing shroud removed. The rower 200 is very similar to the rower 10 described above.

The rower 200 includes a rail 214; a front cross beam foot 217; and a rear cross beam foot hidden from view by an SUP platform 232. The rower 200 further includes a main rigging support 226 and an articulating rigging support 228 that assist in properly guiding actuating cables as the cables are pulled out by the user and then retracted back by the tensioning provided as part of the retraction mechanisms connected to transmission mechanisms and the resistance system. The main rigging support 226 includes a guide wheel 225 on a spindle at the top of the rigging support 226, to maintain the position of a first cable 282 (not visible in this Figure but situated in the same way as in the rower 10 of FIG. 1) and allow the user to pull, for example, on a sweep row handle 281 or sculling oars 224 (one of which is shown in inactive, folded state in the Figure, with the other one symmetrically positioned on the other side of the rail 214). The sweep row handle 281 or the sculling oars 224 attach to the end of the first cable so that the first cable 282 moves through a first transmission mechanism and activates the resistance system. The sweep row handle 281 is shown attached to the fully-retracted (and therefore hidden from view) cable 282 by a carabiner. But as has already been noted, attachments of cables to change configuration/mode of the rower may be performed using other types of releasable or non-releasable fasteners; and adjusting cables may be used to create lengths proper for a given mode and/or a given user and the user's preferences.

The articulating rigging support 228 includes a guide wheel/spindle combination 219 at its end to maintain the position of a second cable 283 as the second cable 283 moves through a second transmission mechanism, activated by the user while the rower 200 is in canoeing or SUP paddling mode. The second cable 283 attaches to one end of an SUP/canoeing paddle 238 (not shown in this Figure) with a releasable or non-releasable cable attachment, turns around the guide wheel 219 at the end of the articulating rigging support 228, travels inside the articulating rigging support 228 to another guide wheel at the other end of the articulating rigging support 228 (near the rail 14) and turns around the other guide wheel to travel towards the front of the rower 200, as is visible in the Figure.

A position-adjustable seat 216 for supporting the user slides on the rail 214, and may be selectively locked in place. Foot supports 222 on each side of the rail 214 are attached to the rail 214, and are designed to receive and support the user's feet. The seat 216 may include a roller system that allows the seat 216 to slide fore and aft on the rail 214 with little resistance. The sculling oars 224 are mounted on each side of the frame. The sculling oars 224 may be made of one or more sections attached with hinge(s) and, when not in use, may be folded for easy storage under the rail 214. Each section of the sculling rower handle may be telescoping and include one of many types of locking mechanisms known in the art to maintain a length that is suitable to the user's size and comfort preference. A housing can be added to contain the sculling oars 224.

A standup paddle board simulation platform 232 is attached at the rear of the rower 200. The SUP platform 232 is pivotably rotatable about a frame upright support 234, which allows the SUP platform 232 to be in a deployed positioned during use, and to be stowed under the frame when not in use. In FIG. 17, the SUP platform 232 is shown in a stowed position. In the deployed position, the SUP platform 232 would be rotated around the frame upright support 234 and protrude at the rear of the rower 200. A locking device fixes the SUP platform 232 in place when the platform is stowed or deployed. Generally, the locking device may be any of many known locking mechanisms, for example, a pop pin. In the rower 200, the SUP platform 232 is normally locked in one of the positions; to move the SUP platform 232, the user can lift the side of the SUP platform 232 by hand, causing the SUP platform 232 to unlock, and then rotate it from the deployed position to the stowed position or vice versa.

When the rower 200 is configured in the sweep rowing configuration using the sweep row handle 281, single oar rowing configuration using one of the sculling oars 224, or dual oar scull rowing configuration using both oars 224, the user operates the resistance system through the cable 282 and the first transmission mechanism.

Figure 18:
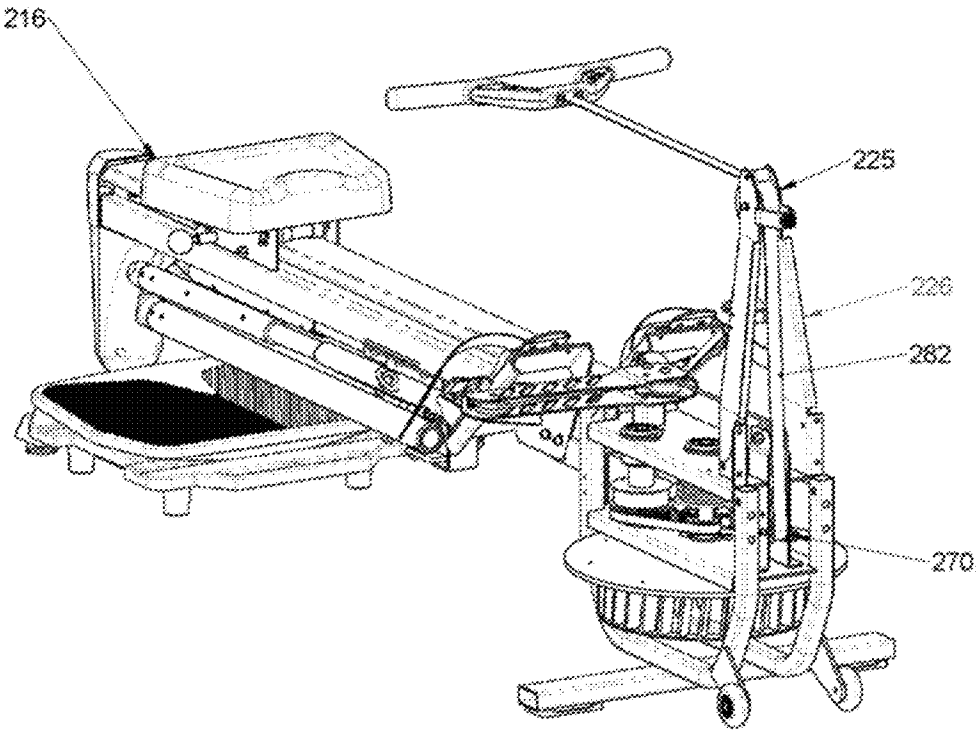
FIG. 18 is another perspective view of the exercise apparatus of FIG. 17.

As shown in FIG. 18, which is another perspective view of the rower 200, substantially from the front, in this embodiment the portion of the cable 282 that wraps around the guide wheel 225 is a flexible ribbon. From the guide wheel 225, the cable 282 goes down the rigging support 226 to another guide wheel 270, where it turns toward the rear of the rower in the direction substantially parallel to the rail 214.

Figure 19:
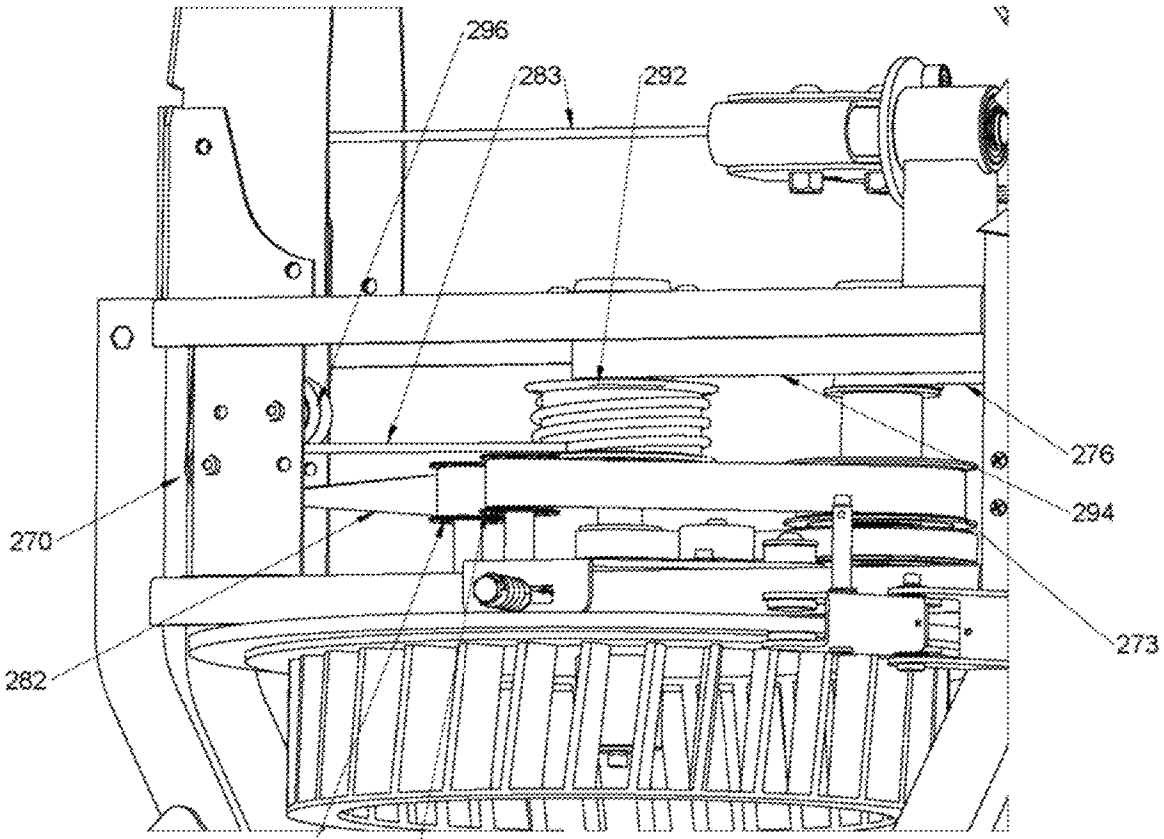
FIG. 19 is a left side close-up view of the details of the transmission mechanisms of the exercise apparatus of FIG. 17.

FIG. 19 is a left side close-up view of the details of the transmission mechanisms of the rower 200. As shown in this and other Figures, the cable 282 runs from the guide wheel 270 to an idler 271. The ribbon of the cable 282 changes its orientation by 90 degrees between the guide wheel 270 and the idler 271. (Note that the axis of the idler 271 is vertical, while the axis of the guide wheel 270 is horizontal and perpendicular to the axis of the rail 214.) From the idler 271, the cable 282 continues to another idler 272 and then to a secondary cable reel 273. The cable 282 wraps around the secondary cable reel 273 sufficient number of times to accommodate the longest expected user pull on the cable 282, and terminates on (attaches to) the secondary cable reel 273 so as to cause the secondary cable reel 273 to rotate when the user pulls on the sweep row handle 281 or the oar(s) 224.

Figure 20:
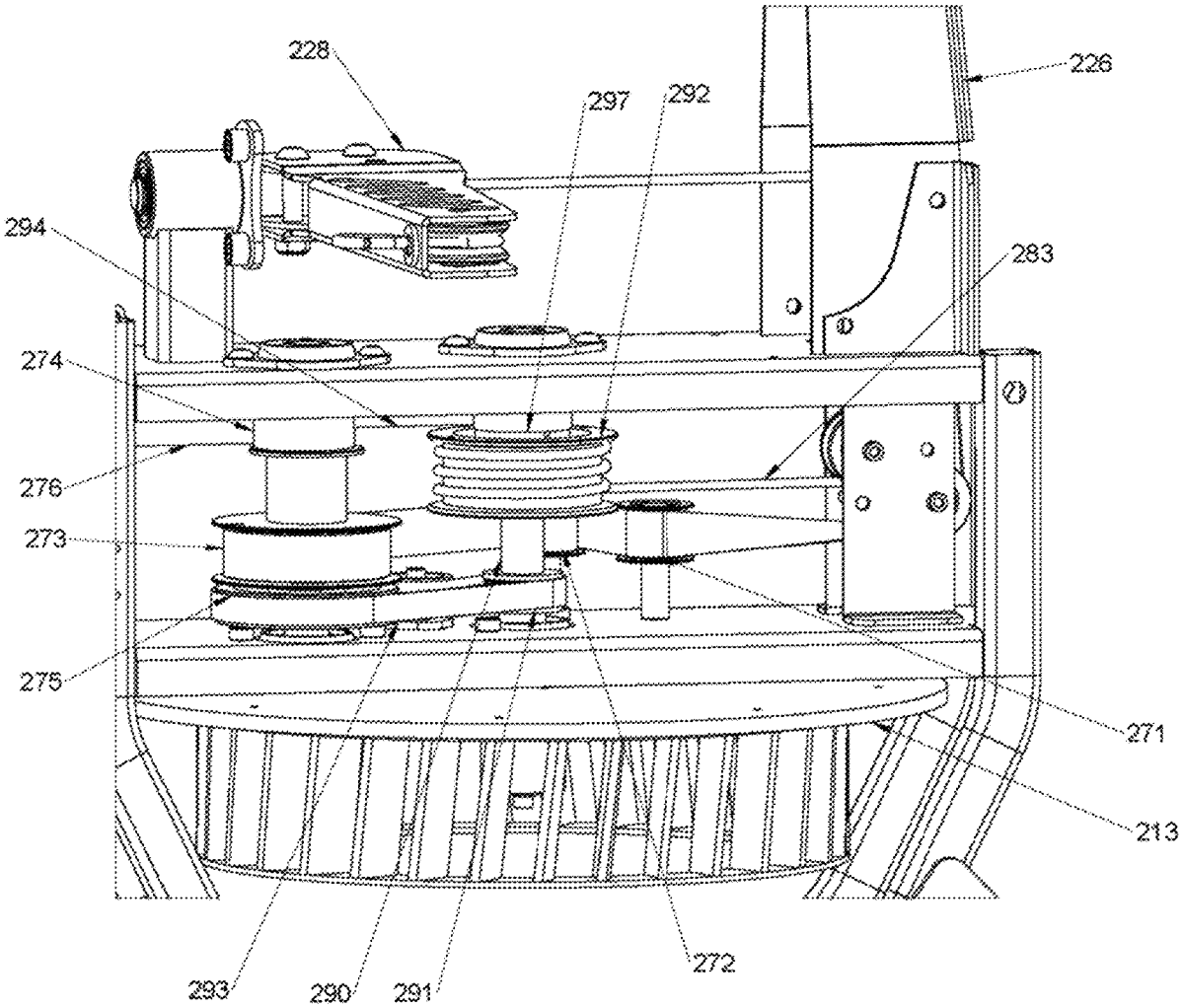
FIG. 20 is a right side close-up view of certain details of the transmission mechanisms of the of the exercise apparatus of FIG. 17.

FIG. 20 is right side close-up view of the details of the transmission mechanisms of the rower 200. The secondary cable reel 273 rotates on a secondary shaft together with a retraction pulley 274; a secondary drive pulley 275 also rotates on the secondary shaft. The secondary shaft is obscured in the Figures by the secondary cable reel 273, the secondary retraction pulley 274, and the secondary drive pulley 275; it is concentric with these three components 273/274/275. A secondary retraction belt 276 is attached to the secondary retraction pulley 274 and wraps around the secondary retraction pulley 274 several times (also to accommodate the longest expected user pull on the cable 282). While one end of the secondary retraction belt 276 is attached to the secondary retraction pulley 274, its other end is attached to a secondary retractor (not shown) inside the rail 214. The secondary retractor can be a rubber band or a spring, for example.

The resistance system here includes a carousel fan 213 (for example, a vented disc with a plurality of angled blades for creating air resistance during rotation), possibly in combination with a magnetic resistance device (not shown). The resistance system is mounted on a primary shaft 290 using a one-way device, so that the rotation of the primary shaft 290 imparts rotation energy to the resistance system, and allows the resistance system to continue rotating even after the primary shaft 290 stops turning. A primary drive pulley 291, a primary cable reel 292, and a primary retraction pulley 297 are also mounted on the primary shaft 290.

As will be seen, the same resistance mechanism is employed in all five modes of operation of the rower 200.

A closed-loop drive belt 293 wraps around the secondary drive pulley 275 and the primary drive pulley 291, transmitting torque from the secondary shaft to the primary shaft 290.

On the primary shaft 290, above the primary cable reel 292, one end of a primary retraction belt 294 is attached; the other end of the primary retraction belt 294 is attached to a primary retractor (not shown) inside the rail 214. The secondary retractor can be a rubber band or a spring, for example.

Figure 21:
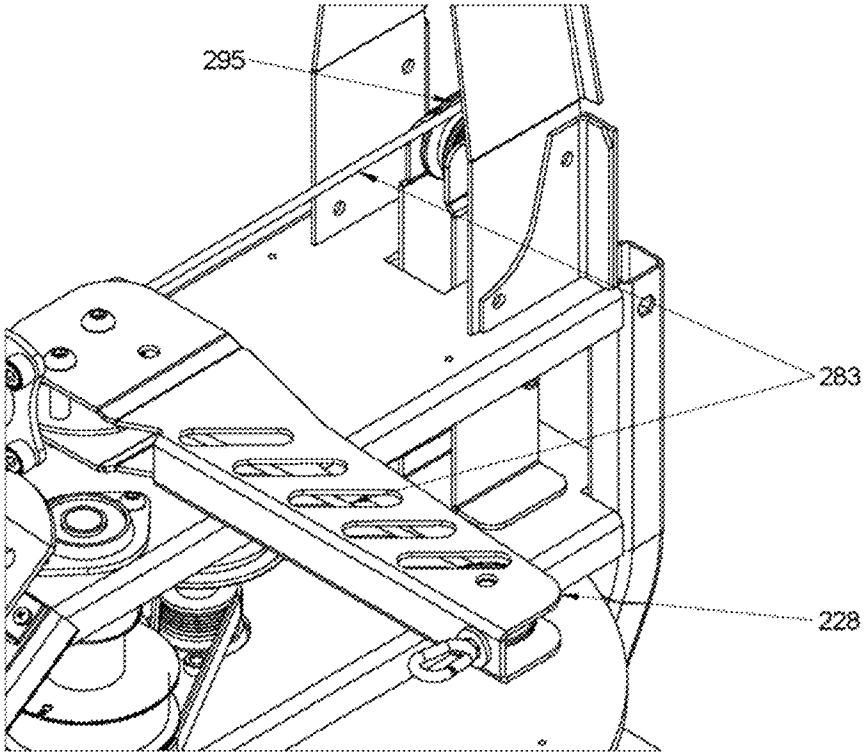
FIG. 21 and FIG. 22 are perspective close-up views of certain details of the transmission mechanisms of the exercise apparatus of FIG. 17.
Figure 22:
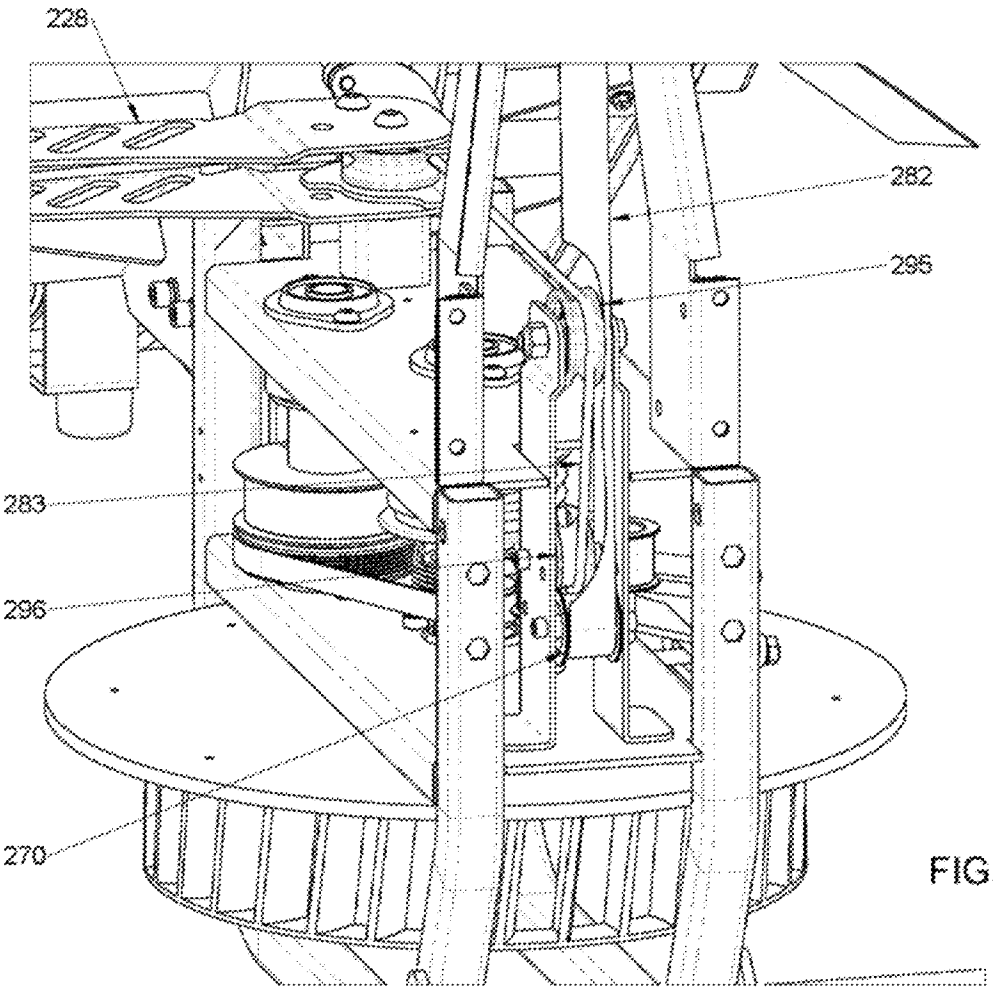

Let us now turn to the components through which the user activates the resistance system 213 through the second cable 283, as would be the case when the rower 200 is configured in the canoeing and SUP modes. In each of these modes, the bottom of the paddle 238 (which can be telescoped to full length for SUP boarding or collapsed to a length more appropriate for canoeing) is attached to the second cable 283, for example, with a clip or a carabiner, or any other type of releasable or non-releasable fastener. As has already been illustrated (see particularly FIG. 17) and described and as is further illustrated in FIG. 21, the second cable 283 turns around the guide wheel 219 at the end of the articulating rigging support 228, travels inside the articulating rigging support 228 to another guide wheel at the other end of the articulating rigging support 228 (near the rail 14) and turns around the other guide wheel to travel towards the front of the rower 200, where it wraps around yet another guide wheel 295 to continue down to guide wheel 296. FIG. 22 illustrates this arrangement; note that the first cable 282 here is pushed slightly off the guide wheel 270 to prevent obscuration of the view of the second cable 283 wrapped around the guide wheels 295 and 296.

As is illustrated in FIG. 19, the second cable 283 continues from the guide wheel 296 to wrap around the primary cable reel 292 a sufficient number of times to accommodate the longest expected user pull on the cable 283. The second cable 283 terminates on (attaches to) the primary cable reel 292.

The secondary cable reel 273 and the secondary retraction pulley 274 are both attached to the secondary shaft with a secondary one-way device and rotate together on the secondary shaft; the secondary drive pulley 275 is attached to the secondary shaft rigidly (i.e., not in a one-way fashion, to rotate in both directions together with the secondary shaft). Similarly, the primary cable reel 292 and the primary retraction pulley 297 are both attached to the primary shaft 290 with a primary one-way device and rotate together on the primary shaft 290; the primary drive pulley 291 is attached to the primary shaft 290 to rotate in both directions together with the primary shaft 290 (i.e., not in a one-way fashion).

In operation, when the user pulls on the oar(s) 224 or the sweep row handle 281 during the power stroke, the tension in the cable 282 is transmitted via the guide wheels 225/270 and the idlers 271/272 and unwinds from the secondary cable reel 273, thereby rotating the secondary cable reel 273 together with the secondary shaft, the secondary retraction pulley 274, and the secondary drive pulley 275. As the secondary retraction pulley 274 rotates, the secondary retraction belt 276 winds on this pulley, pulling on and extending the secondary retractor (e.g., spring, rubber band); the extension of the secondary retractor will facilitate retraction of the cable 282 on the return (non-power) stroke of the oar(s) 224 or the sweep row handle 281. The drive belt 293 and the primary drive pulley 291 transmit the rotation/torque from the secondary shaft to the primary shaft 290, which operates the resistance system (e.g., the carousel fan 213, a magnetic resistance device, and a flywheel) of the rower 200 via the one-way device that attaches the primary shaft 290 to the resistance system (the "resistance system one-way device").

At the end of the power stroke, the secondary retractor pulls on the secondary retraction belt 276, turning the secondary shaft in the direction opposite that during the power stroke. The secondary cable reel 273 spools the cable 282, facilitating the return stroke of the oar(s) 224 or the sweep row handle 281.

As can be seen from the above paragraphs describing the operation of the rower 200 using the oar(s) 224 or the sweep row handle 281, the "first transmission mechanism" of the rower includes the guide wheels 225/270, the idlers 271/272, the secondary shaft, the secondary cable reel 273, the drive pulleys 275/291, the drive belt 293, and the secondary one-way device.

In the SUP paddling or canoeing modes, the user moves the paddle 238 (either telescoped/extended for SUP boarding, or not extended, for canoeing) thereby pulling on the cable 283. During the power stroke, the tension in the cable 283 is transmitted via the guide wheel 219, another guide wheel (at the other end of the articulating rigging support 228 near the rail 14), the guide wheels 295/296, and unwinds thereby rotating the primary cable reel 292 together with the primary shaft 290 and the primary retraction pulley 297. As the primary retraction pulley 297 rotates, the primary retraction belt 294 winds in this pulley, extending the primary retractor (e.g., spring, rubber band); the extension of the primary retractor will facilitate retraction of the cable 283 on the return (non-power) stroke of the paddle 238. The rotation of the primary shaft 290 operates the resistance system of the rower 200 via the one-way device that attaches the primary shaft 290 to the resistance system (the "resistance system one-way device").

At the end of the power stroke, the primary retractor pulls on the primary retraction belt 294, turning the primary shaft 290 in the direction opposite that during the power stroke. The primary cable reel 292 spools the cable 283, facilitating the return stroke of the paddle 238.

As can be seen from the above paragraphs describing the operation of the rower 200 using the paddle 238, the "second transmission mechanism" of the rower includes the guide wheel 219, the guide wheel at the other end of the articulating rigging support 228 near the rail 14, the guide wheels 295/296, the primary cable reel 292, and the primary one-way device.

Note a pair of wheels 260 (FIGS. 17, 18, and 20) at the front of the rower 200. They facilitate movement of the rower 200, which can be transported by tilting and pushing. In a variant, another, similar third wheel is added at the front of the main rigging support 226 (for example, above the guide wheel 225), so that the rower 260 can be pushed into a vertical position to rest on the wheels 260 and the third wheel.

Figure 23:
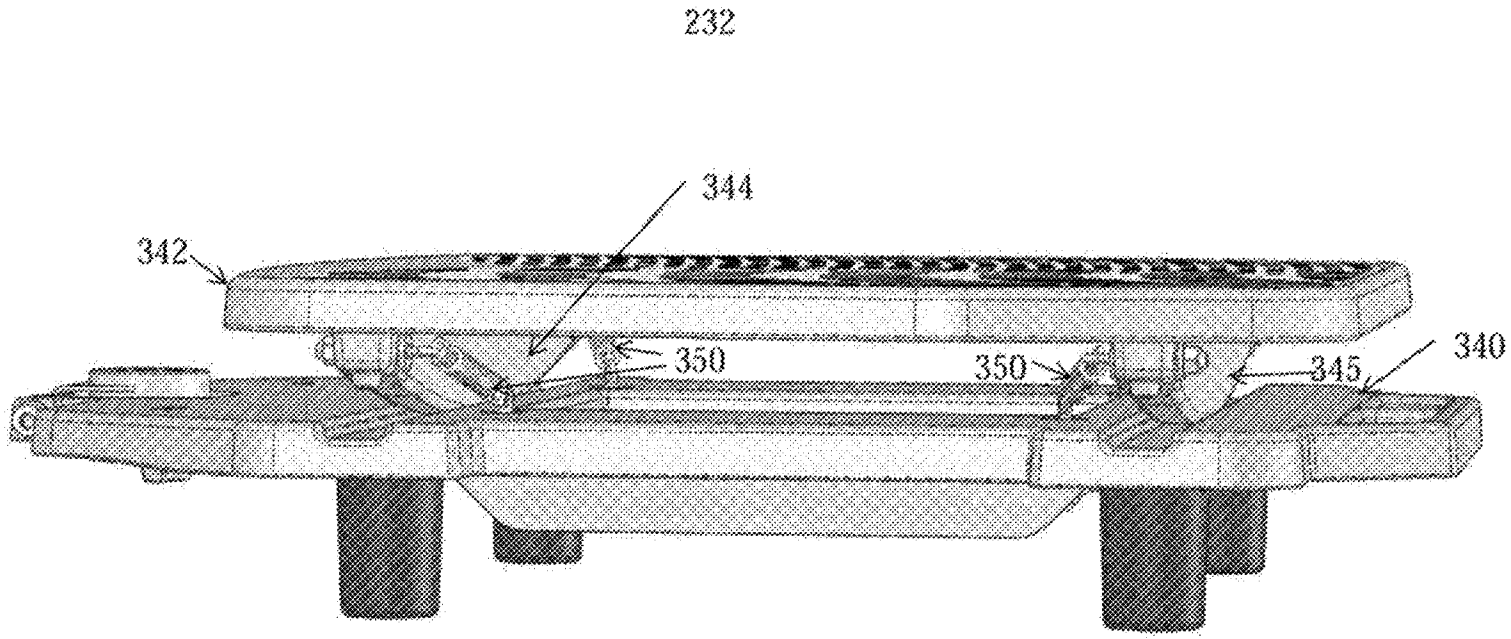
FIG. 23 is a perspective of a stand-up paddling platform.
Figure 24:
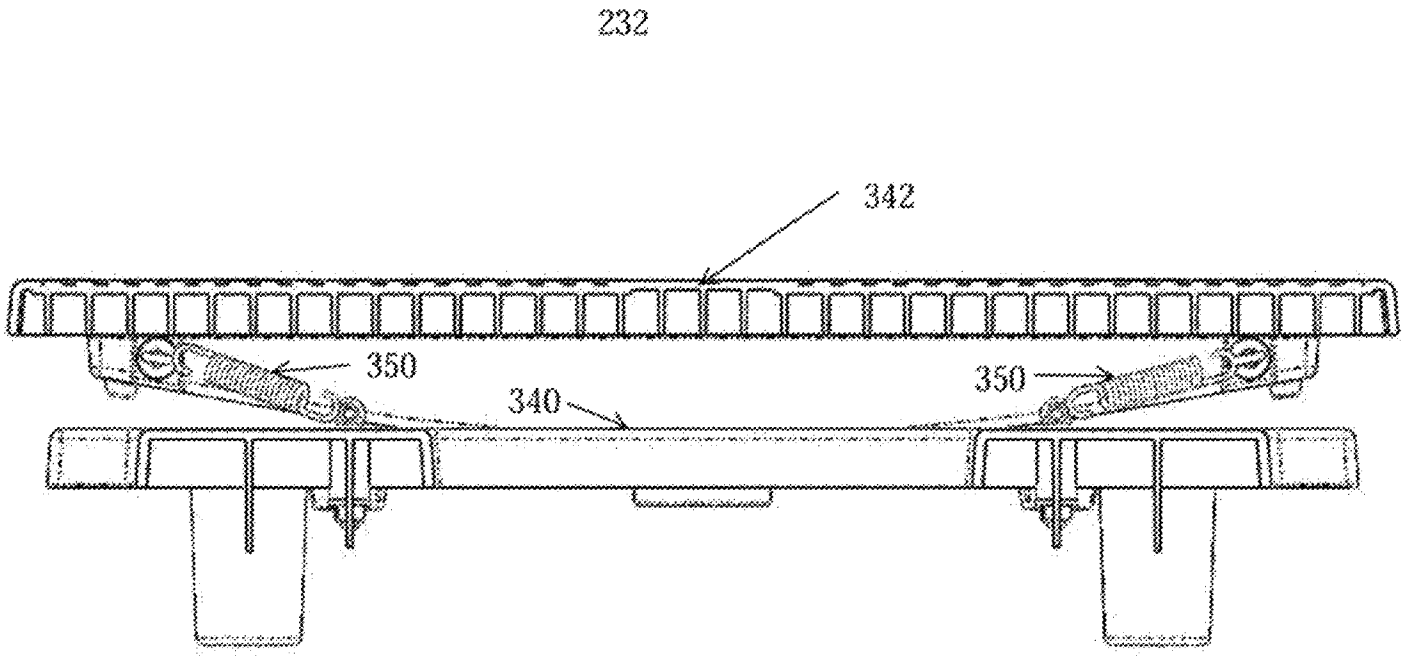
FIG. 24 is a rear cutaway view of the stand-up paddling platform of FIG. 23.
Figure 25:
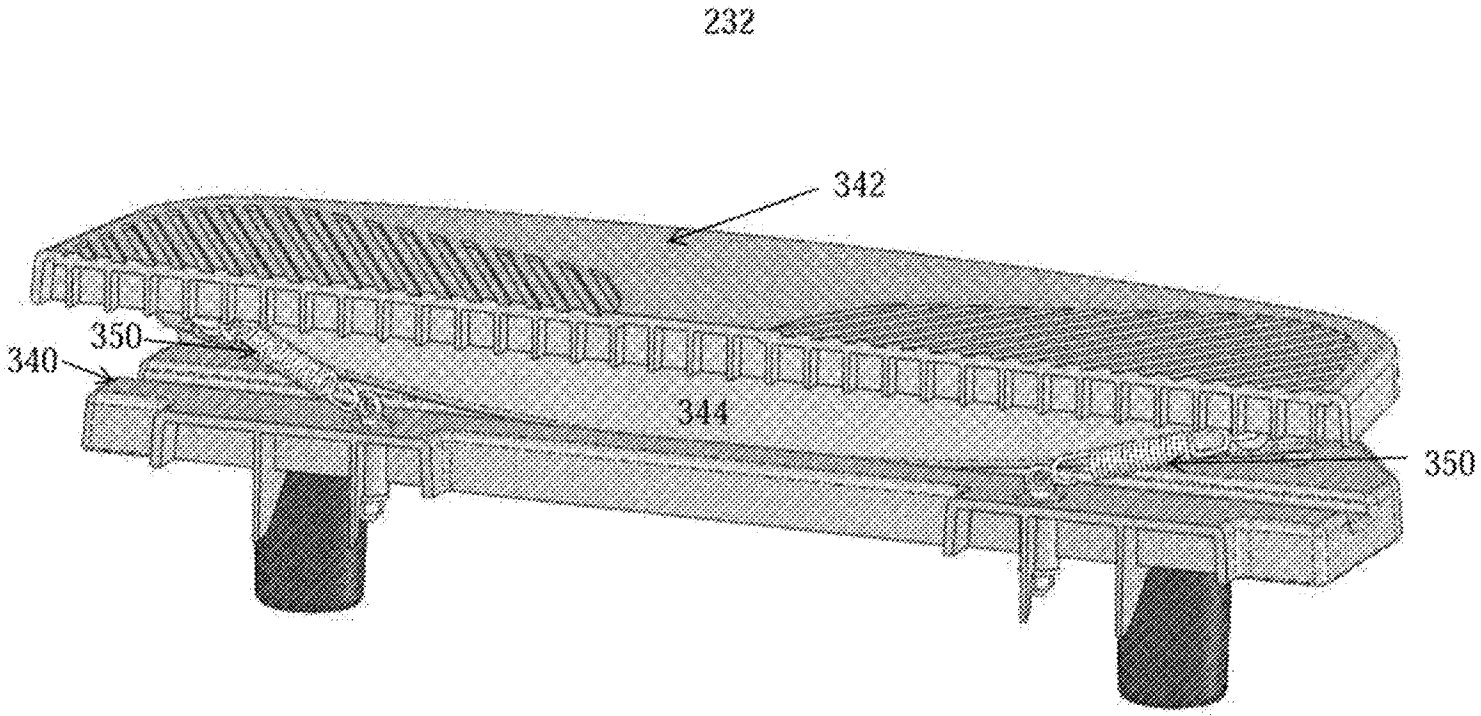
FIG. 25 is a perspective cutaway view of the stand-up paddling platform of FIGS. 23 and 24.

FIGS. 23-25 illustrate details of an embodiment of the SUP platform 232, where FIG. 23 is a shallow angle perspective view, FIG. 24 is a rear cutaway view, and FIG. 25 is a perspective cutaway view. The upper member 342 is supported on the base member 340 by one or more arc-shaped support members. In the embodiment of FIGS. 23-26, two arc support members 344 are shown. Several extension type centering springs 350 are attached between the upper support member 342 and the base member 340 at such an angle and position as to provide a centering force to influence the upper member 342 to a level (horizontal) position. In this embodiment, the upper member 342 can tilt approximately 20-30 degrees along the arc from the horizontal orientation (for a typical user weight of up to 350 pounds). The velocity of tilt can be controlled by the tension of the centering springs. Note that rubber or other elastic material centering members may be used instead of the centering springs, and the velocity of tilt can be controlled by the density of rubber or the other elastic material that is used for the centering springs. The arc-shaped support members 344 provide for limited flexing of the upper member 342, such that the user experiences movement of the upper member 342 of the platform 232 in a manner that simulates the movement of a standup paddle board as it floats on the water.

An alternative method for storage and attachment of the SUP platform 232 has also been considered. The SUP platform 232 may be attached to the frame upright support 234 via a fixed pivot which will allow for the SUP platform 232 to rotate from the horizontal plane to the vertical plane. The SUP platform 232 would be in the horizontal or deployed position at the rear of the rower when it is used, and then could be lifted and pivoted upwards to the vertical position for storage.

The various resistance systems mentioned in this document include not only fan-type mechanisms that use air resistance, but other types as well. For example, variable magnetic resistance mechanisms can be used, and combinations of fan-type and magnetic resistance mechanisms. Such combinations have the advantages of approximating the non-linear resistance of water to a moving paddle using the fan-type mechanism, but also of providing some base level magnetic resistance that might be preferred by beginner users.

The features described throughout this document may be present individually, or in any combination or permutation, except where the presence or absence of specific elements/limitations is inherently required, explicitly indicated, or otherwise made clear from the context.

Not every illustrated element is necessarily required in every embodiment in accordance with the concepts described in this document, while some element that have not been specifically illustrated may be desirable in some embodiments in accordance with the concepts.

This document describes in detail the inventive multi-functional rowers. This was done for illustration purposes and, therefore, the foregoing description is not necessarily intended to limit the spirit and scope of the invention(s) described. Neither the specific embodiments of the invention(s) as a whole, nor those of its (or their, as the case may be) features necessarily limit the general principles underlying the invention(s). The specific features described herein may be used in some embodiments, but not in others, without departure from the spirit and scope of the invention(s) as set forth herein. Various physical arrangements of components and various step sequences also fall within the intended scope of the invention(s). Many additional modifications are intended in the foregoing disclosure, and it will be appreciated by those of ordinary skill in the pertinent art that in some instances some features will be employed in the absence of a corresponding use of other features. The embodiments described above are illustrative and not necessarily limiting, although they or their selected features may be limiting for some claims. The illustrative examples therefore do not necessarily define the metes and bounds of the invention(s) and the legal protection afforded the invention(s).

What is claimed is:

1. A multi-functional exercise rower comprising:

a frame;

a rail attached to the frame;

a seat slidable on the rail, the seat being selectively lockable on the rail;

a resistance system attached to the frame;

a primary shaft;

a resistance system one-way device attaching the primary shaft to the resistance system;

a first foldable oar attached to one side of the frame and a second foldable oar attached to another side of the frame;

a main rigging support attached to the frame;

an articulating rigging support attached to the rail or to the frame and configured to pivot from side to side;

a first cable comprising a first end of the first cable and a second end of the first cable;

a first fastener configured to couple selectively the first end of the first cable to at least one first item adapted to be pulled by a user of the multi-functional exercise rower in the course of the user's exercising;

a second cable comprising a first end of the second cable and a second end of the second cable;

a second fastener configured to couple the first end of the second cable to a paddle;

a first transmission mechanism configured to operate the resistance system when the user pulls on the at least one first item when the at least one first item is coupled with the first fastener to the first end of the first cable, wherein the first transmission mechanism guides the first cable through the main rigging support; and a second transmission mechanism configured to operate the resistance system when the user pulls on the paddle when the paddle is coupled with the second fastener to the first end of the second cable, wherein the second transmission mechanism guides the second cable through the articulating rigging support.

2. The multi-functional exercise rower according to claim 1, wherein the at least one first item is selected from the group consisting of the first foldable oar, the second foldable oar, the first foldable oar and the second foldable oar, and a sweep row handle.

3. The multi-functional exercise rower according to claim 2, further comprising the paddle.

4. The multi-functional exercise rower according to claim 3, wherein the paddle is adjustable in length to simulate a canoeing paddle and a paddle for SUP boarding.

5. The multi-functional exercise rower according to claim 4, wherein the rail comprises parts defining a storage compartment for the paddle.

6. The multi-functional exercise rower according to claim 5, further comprising an SUP platform attached to the frame behind the seat, the SUP platform being rotatable and lockable in a deployed horizontal position behind the frame, and in a stowed position selected from the group consisting of a stowed position under the frame and a stowed vertical position behind the frame.

7. The multi-functional exercise rower according to claim 6, wherein the SUP platform comprises an upper platform member, a base platform member, and a pair of compressible support members between the upper platform member and the base platform member to allow flexing of the upper platform member, thereby simulating movement of a paddle board on water.

8. The multi-functional exercise rower according to claim 7, wherein the pair of compressible support members allow tilting of the upper platform member up to 30 degrees when the user exercises on the SUP platform and the user's weight does not exceed 350 pounds.

9. The multi-functional exercise rower according to claim 6, wherein the SUP platform comprises an upper platform member, a base platform member, and one or more inflated bladders between the upper platform member and the base platform member to allow flexing of the upper platform member, thereby simulating movement of a paddle board on water.

10. The multi-functional exercise rower according to claim 6, wherein the SUP platform comprises an upper platform member, a base platform member, a pair of springed arc support members attached between the upper platform member and the base platform member to support the upper platform member on the base platform member, and a plurality of extension centering springs, each extension centering spring of the plurality of extension centering springs being attached between the upper platform member and the base platform member to provide a centering force to influence the upper platform member to a level position, so that the upper platform member is allowed to flex thereby simulating movement of a paddle board on water.

11. The multi-functional exercise rower according to claim 5, further comprising the sweep row handle.

12. The multi-functional exercise rower according to claim 5, further comprising a first retraction mechanism configured to retract the first cable, and a second retraction mechanism configured to retract the second cable.

13. The multi-functional exercise rower according to claim 5, wherein the first transmission mechanism comprises a first plurality of guide wheels, a first plurality of idlers, a secondary shaft, a secondary cable reel, a first pulley, a second pulley, a drive belt coupling the first pulley and the second pulley, and a secondary one-way device attaching the secondary cable reel to the secondary shaft.

14. The multi-functional exercise rower according to claim 13, wherein second transmission mechanism comprises a second plurality of guide wheels, a primary cable reel, and a primary one-way device attaching the primary cable reel to the primary shaft.

15. The multi-functional exercise rower according to claim 5, wherein the resistance system comprises an air resistance mechanism and a variable magnetic resistance mechanism.

16. The multi-functional exercise rower according to claim 5, wherein the first cable comprises a ribbon.

17. The multi-functional exercise rower according to claim 5, further comprising a housing enclosing the resistance system, portions of the first transmission mechanism, and portions of the second transmission mechanism.

18. The multi-functional exercise rower according to claim 16, further comprising a lockable frame pivot connecting the rail with the housing, thereby enabling the user to bring the rail into a vertical plane and decrease the footprint of the multi-functional exercise rower for storage.

19. The multi-functional exercise rower according to claim 18, further comprising one or more wheels attached to the bottom of the housing, thereby enabling the user to tilt the rail in the vertical plane and transport the multi-functional exercise rower using the wheel.

20. The multi-functional exercise rower according to claim 19, wherein the one or more wheels comprise a pair of wheels, the multi-functional exercise rower further comprising a third wheel attached to the front of the main rigging support, thereby enabling the user to tilt the multi-functional exercise rower in the vertical plane and transport the multi-functional rower using the pair of wheels and the third wheel.

21. A multi-functional exercise rower comprising:

a frame;

a rail attached to the frame;

a seat slidable on the rail, the seat being selectively lockable on the rail;

a resistance system attached to the frame;

a primary shaft;

a resistance system one-way device attaching the primary shaft to the resistance system;

a first foldable oar attached to one side of the frame and a second foldable oar attached to another side of the frame;

a main rigging support attached to the frame;

an articulating rigging support attached to the rail or to the frame and configured to pivot from side to side;

a first cable comprising a first end of the first cable and a second end of the first cable;

a first fastener configured to couple selectively the first end of the first cable to at least one first item adapted to be pulled by a user of the multi-functional exercise rower in the course of the user's exercising;

a second cable comprising a first end of the second cable and a second end of the second cable;

a second fastener configured to couple the first end of the second cable to a paddle;

a first transmission means for operating the resistance system when the user pulls on the at least one first item when the at least one first item is coupled with the first fastener to the first end of the first cable; and a second transmission means for operating the resistance system when the user pulls on the paddle when the paddle is coupled with the second fastener to the first end of the second cable.

* * * * *